US006431559B1

(12) United States Patent
Tlucko

(10) Patent No.: US 6,431,559 B1
(45) Date of Patent: Aug. 13, 2002

(54) SKATE WITH PIVOTING FRONT WHEELS

(76) Inventor: Juraj George Tlucko, 183 Main St., Boxford, MA (US) 01921-2517

( * ) Notice: Subject to any disclaimer, the term of this patent is extended or adjusted under 35 U.S.C. 154(b) by 0 days.

(21) Appl. No.: 09/699,149

(22) Filed: Oct. 28, 2000

Related U.S. Application Data

(63) Continuation-in-part of application No. 09/344,589, filed on Jun. 25, 1999.
(60) Provisional application No. 60/090,804, filed on Jun. 26, 1998.

(51) Int. Cl.[7] ..... A63C 17/06
(52) U.S. Cl. ..... 280/11.221; 280/11.15; 280/11.19; 280/11.27; 280/11.223; 280/11.224; 280/11.231
(58) Field of Search ..... 280/11.221, 11.223, 280/11.224, 11.27, 11.231, 11.19, 11.26, 842, 11.15

(56) References Cited

U.S. PATENT DOCUMENTS 1,228,544 A * 6/1917 Falstrem et al. ..... 280/11.15
4,272,090 A * 6/1981 Wheat ..... 280/11.231
5,135,244 A * 8/1992 Allison ..... 280/11.28
5,342,071 A * 8/1994 Soo ..... 280/11.22
5,503,413 A * 4/1996 Belogour ..... 280/11.225
5,634,648 A * 6/1997 Tonel et al. ..... 280/11.232
5,823,543 A * 10/1998 Burns et al. ..... 280/11.225
5,890,724 A * 4/1999 Gignoux et al. ..... 280/11.28
5,904,359 A * 5/1999 Caeran et al. ..... 280/11.15
5,979,916 A * 11/1999 Gatel et al. ..... 280/11.224
6,017,041 A * 1/2000 Gignoux ..... 280/11.231
6,056,299 A * 5/2000 Soo ..... 280/11.27

* cited by examiner

*Primary Examiner*—Paul N. Dickson
*Assistant Examiner*—Deanna Draper
(74) *Attorney, Agent, or Firm*—O'Connell Law Firm

(57) ABSTRACT

An in-line skate with a main skate frame, a skate boot, a carriage frame pivotally coupled to the main skate frame, a plurality of wheels forming a pivoting wheel group, and at least one wheel forming a fixed wheel group. A pivot axis of the carriage frame can be horizontally located anterior to a reference point that is three-tenths of the length of the open inner volume of the skate boot from the anterior end of the open inner volume, and the pivot axis could be aligned with or anterior to the anterior end of the skate boot. The pivot axis can be vertically located immediately adjacent to the skate boot sole or coincident with or distal to the sole. A pivoting mechanism can enable the carriage frame to pivot above an effective pivot axis that is physically displaced from the pivoting mechanism.

25 Claims, 16 Drawing Sheets

SKATE WITH PIVOTING FRONT WHEELS

This application is a CIP of U.S. application Ser. No. 09/344,589, filed Jun. 25, 1999 and claims priority from provisional application Ser. No. 60/090,804, filed Jun. 26, 1998.

FIELD OF THE INVENTION

The present invention relates generally to skating. More particularly, disclosed herein is a skate with two or more front wheels that pivot relative to a skate frame for improving the efficiency of each skating stroke while extending each stroke's effective length.

BACKGROUND OF THE INVENTION

In-line skates of the prior art typically comprise a plurality of rotatable wheels fixed in place in a common line relative to a skate boot that receives a skater's foot. The wheels normally have a common tangent such that all wheels will contact a flat surface when the in-line skate rests thereon. With such a construction, a skater will tend to be propelled in a given direction by orienting the skate transverse to the desired direction of travel and applying a lateral driving force to the skate primarily with the skater's leg muscles.

As one knowledgeable in the art will be aware, propulsion is most effectively achieved when the plurality of wheels of the in-line skate are all in contact with the ground surface on which the skater is propelled. With a plurality of wheels in contact with the ground, the leg enjoys a stability that allows it to drive with virtually unlimited force with little or no effort required for stabilizing the skate.

However, the experienced skater will be aware that it is substantially impossible for a skater to keep all wheels of such an in-line skate in contact with the ground surface over the entire skating stroke. Doing so is particularly problematic during the final phase of leg extension. As the leg enters its final stage, the rear wheels of the skate inevitably will follow the skater's heel in lifting off of the ground surface. With this, since the wheels are fixed in position relative to the skater's foot, only the foremost wheel remains in contact with the ground whereby it becomes the skaters only means of applying a driving force to the ground. This is plainly evidenced by the uneven wear that the wheels of the in-line skate typically exhibit wherein the foremost wheel normally demands replacement well before the useful lifetime of the rear wheels has expired.

Unfortunately, the effects of a skater's being unable to keep all wheels in contact with the ground over the entire skating stroke go well beyond mere uneven wheel wear. What for most will be considered a far more important repercussion is that a skater is resultantly unable to transmit all available energy from the skater's leg to the ground surface. Instead, as the rear wheels are lifted off the ground and only the front wheel remains in contact with the ground for driving the skater, stabilizing the skater's leg, and enabling other performance characteristics required for most effective propulsion.

Similar disadvantages have been addressed relative to ice skates, for example, by designing blades with convex formal edges so that an increased blade surface will have contact with an ice surface at the end of the skating stroke. Furthermore, ice skates have been developed that allow a pivoting of the skate blade relative to the skate boot about an axis adjacent the toe end of the skate whereby the skate blade exhibits improved contact with the ice surface over final phase of leg extension. As one knowledgeable regarding the sport of speed skating will be well aware, this construction has proven to be a decided advantage over prior art fixed blade constructions.

However, attempting to produce a convex blade profile with in-line skate wheels would require superfluous weight in wheels that would have only relatively minimal contact with the ground. Also, the convex wheel distribution would be easily upset with the rapid wearing typical of skate wheels and the uneven surfaces over which in-line skates must travel. Furthermore, attempting to provide an in-line skate with an all-wheel pivoting blade structure has proven to be unacceptable due to vibrations, undesirable weight and leg stress, and unmanageably complex mechanical requirements.

Advantageously, a number of inventors have endeavored to provide an in-line skate that overcomes these disadvantages. For example, U.S. Pat. No. 4,272,090 was granted to Wheat in 1981 for an in-line skate that has a pivoting front wheel bogie and a fixed rear wheel unit mounted separately to a shoe portion of the skate. The front wheel bogie is disclosed as having an axis of rotation located horizontally at a mid-portion of the skate and vertically well below the bottom of the shoe portion of the skate. With this, the skate is said to provide stable floor contact of the wheels on the front bogie even while the heel and thus the rear wheel unit of the skate is raised from the ground as would happen during the final portion of the skating stroke.

Another in-line skate designed with similar intention is disclosed in the 1997 U.S. Pat. No. 5,634,648 to Tonel et al. In this skate, a front body is rotatably coupled to a rear body, and a pair of wheels is rigidly coupled to each of the front and rear bodies. With this, during the final phase of the skating stroke, the front body will rotate relative to the rear body to allow the front pair of wheels to maintain contact with the ground thereby improving the skater's comfortability and the effectiveness of the skating stroke.

It must be recognized that these and other skating inventions certainly represent improvements in the art of in-line skating. For a number of reasons, however, even skates embodying these inventions are less than ideal. For example, by disposing the axis of rotation of the front wheel bogie horizontally at the mid portion of the skate and vertically displaced below the bottom of the shoe portion of the skate, skates such as the skate of the '090 patent compromise the effective length of the skating stroke. The rearward horizontal location of the axis of rotation of the front wheel bogie naturally results in the front wheels being disposed posteriorly along the skate from the outset. With this, the skating stroke is abbreviated. Furthermore, the vertically displaced location of the bogie's axis of rotation cause it to rotate rearwardly relative to the shoe portion of the skate during the final portion of the skating stroke whereby the front wheels move even farther back relative to the shoe portion thereby further abbreviating and reducing the effectiveness of the skating stroke.

Also, skates such as that disclosed in the '648 patent that have pivoting boot sections sacrifice the rigidity of the skate structure that is desirable for full force transmission from the skater's leg, through the skate, and to the ground. With this, energy is lost and most efficient propulsion is compromised. Furthermore, the pivoting boot structure is undesirably complex and vulnerable to wear and breakage.

In light of the foregoing, it is clear that there remains a need in the art for an in-line skate that overcomes the disadvantages of the prior art by providing a skate that enables optimal propulsion over an extended skating stroke.

SUMMARY OF THE INVENTION

Advantageously, the present invention sets forth with the broadly stated object of providing an in-line skate that solves each of the problems left by the prior art while providing a number of heretofore unrealized advantages.

Stated more particularly, a principal object of the present invention is to provide an in-line skate that provides an extended skating stroke.

A further object of the invention is to provide an in-line skate that provides for an efficient transmission of force from a skater's leg to the ground on which the skater is propelled.

Still another object of the invention is to provide an in-line skate that is exceedingly simple yet lightweight in construction.

Certainly these and further objects and advantages of the present invention will be obvious both to one who reviews the present specification and drawings and to one who has an opportunity to make use of an embodiment of the present invention.

In accomplishing the aforementioned objects, an embodiment of the present invention essentially comprises a main skate frame with an anterior end and a posterior end; a carriage frame pivotally coupled to the skate frame; a plurality of wheels comprising a pivoting wheel group rotatably coupled to the carriage frame; and at least one wheel comprising a fixed wheel group rotatably coupled to the main skate frame. Under this arrangement, the pivoting wheel group can pivot with the carriage frame relative to the main skate frame to maintain contact with a ground surface throughout a range of pivoting of the main skate frame relative to the ground surface. Of course, a skate boot with an anterior end, a posterior end, a sole, and an open inner volume of a given length for receiving a skater's foot may be coupled to the skate frame.

Advantageously, the present inventor has discovered that moving the pivot axis of the carriage frame forward along the length of the skate will lengthen and improve the effectiveness of the skating stroke. With this, the horizontal position of the pivot axis preferably will be anterior to the center of the first metatarsophalangeal joint of the plantar area of the foot. Research has determined that the center of the first metatarsophalangeal joint typically will be approximately three-tenths of the length of the foot from the tip of the person's big toe. Even more preferably, the pivot axis will be aligned with or anterior to the anterior end of the skate boot whereby the skating stroke will be even further lengthened and improved.

Although manipulating the horizontal position of the pivot axis surely provides for an improved in-line skate, the inventor has further discovered that manipulation of the vertical location of the pivot axis also provides for added advantage. For example, by locating the pivot axis immediately adjacent to the sole of the skate boot, the present invention minimizes the tendency of the pivot axis to move backwardly when the main skate frame is rotated relative to a ground surface. Furthermore, this tendency can be substantially eliminated by locating the pivot axis approximately coincident with the sole of the skate boot. Indeed, the present inventor has discovered that locating the pivot axis distal to the sole of the skate boot relative to the wheels of the in-line skate will reverse this undesirable tendency whereby the pivot axis of the carriage frame will actually move forwardly when the main skate frame is rotated as the posterior end of the main skate frame is lifted from the ground while the anterior end of the frame tends to stay in contact with the ground.

In certain alternative embodiments, the enlarged portion and the elevated retaining plateau can be eliminated while still having the in-line skate enjoy an effective pivot axis in a desired location. To do so, the carriage frame can be pivotally coupled to the skate body by a pivoting mechanism that enables the carriage frame to pivot above an effective pivot axis that is physically displaced from the pivoting mechanism. With such a construction, the carriage frame can pivot about a predetermined effective pivot axis without requiring the pivoting mechanism to be located at the effective pivot axis.

The pivoting mechanism could pursue a number of embodiments. For example, a first embodiment incorporates a first curved surface, which may comprise an external curve, that is fixedly associated with the skate body that is in relatively slidable contact with a second curved surface, which may comprise an internal curve, that is fixedly associated with the carriage frame. Under this arrangement, the first and second curved surfaces can slide relative to one another to allow the carriage frame to pivot relative to the skate body. Even more advantageously, the first and second curves could be interlocked by a pair of engaging shoulders on, for example, the first curved surface in combination with a C-channel on, for example, the second curved surface.

In a second embodiment, the pivoting mechanism can comprise a laterally disposed arcuate passage, which may pass through the carriage frame, in combination with a plurality of pivot support rods, which can have first and second ends coupled to first and second pivot support plates and body portions passing through the arcuate passage. There can be three pivot support rods disposed in a triangular relationship with a given effective height, and the arcuate passage can have a width slightly greater than the effective height of the triangle formed by the three pivot support rods. Under this arrangement, the carriage frame can pivot relative to the skate body around an effective pivot axis by having the pivot support rods travel along the arcuate passage.

Advantageously, in either embodiment the location of the effective pivot axis can be manipulated to further the invention's goals of improving the length and efficiency of a skater's skating stroke. For example, where first and second curved surfaces are employed, the location of the effective pivot axis can be manipulated by adjustment of the radii of curvature and orientation of the curved surfaces. Similarly, where an arcuate passage is combined with a plurality of pivot support rods, the location of the effective pivot axis can be controlled by a manipulation of the radius of curvature and orientation of the arcuate passage.

One will appreciate that the foregoing discussion merely outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF THE INVENTION

To ensure that one skilled in the art will fully understand and, in appropriate cases, be able to practice the present invention, certain preferred embodiments of the broader invention revealed herein are described below and shown in the accompanying drawing figures.

Figure 1:
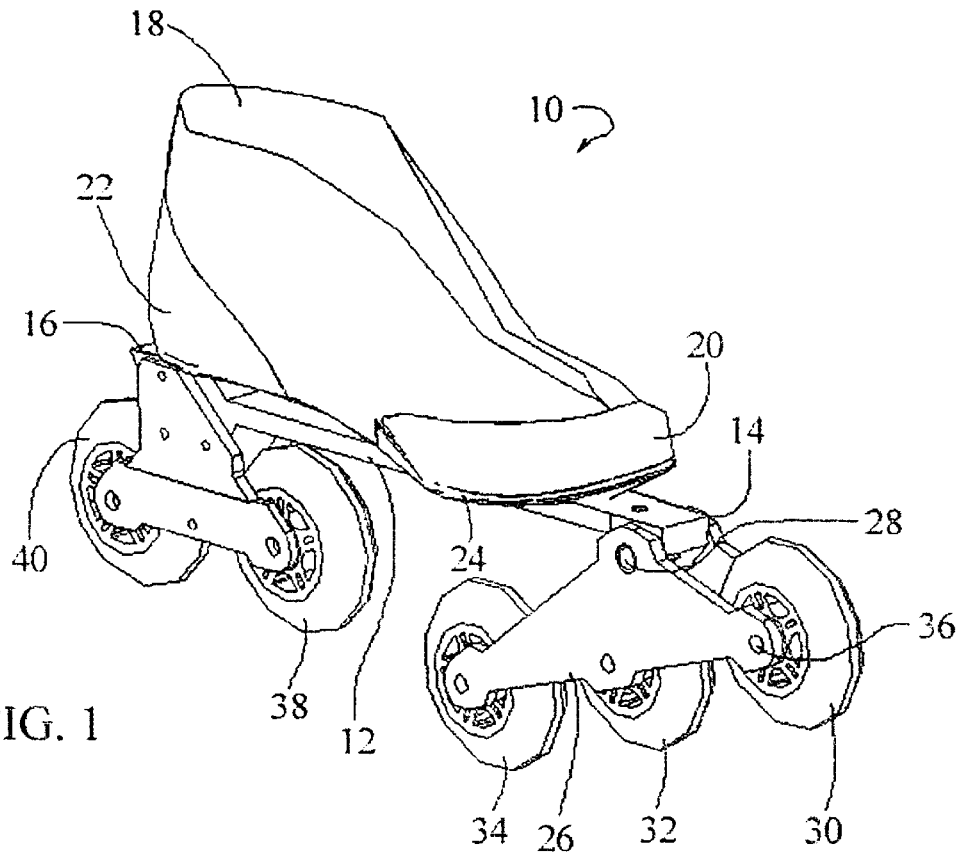
FIG. 1 is a perspective view of an in-line skate according to the present invention.

In FIG. 1, an in-line skate according to the present invention is indicated generally at 10. In FIG. 1, one sees that the in-line skate 10 is founded on a main skate frame 12 that has an anterior end 14 and a posterior end 16. A skate boot 18 with an anterior end 20 and a posterior end 22 is coupled to the main skate frame 12. The skate boot 18 also has a sole 24 and an open inner volume (not shown in FIG. 1) of a given length for receiving a skater's foot (not shown in FIG. 1). A carriage frame 26, which may be termed a sub-frame, is pivotally coupled to the main skate frame 12 to pivot about a pivot axis 28 adjacent to the anterior end 14 of the main skate frame 12.

First, second, and third wheels 30, 32, and 34 are rotatably coupled to the pivoting carriage frame 26 whereby the wheels 30, 32, and 34 comprise a pivoting wheel group. Each of the wheels 30, 32, 34, rotates about an axis 36. Fourth and fifth wheels 38 and 40 are rotatably coupled to the main skate frame 12 adjacent to the posterior end 16 of the main skate frame 12 whereby the fourth and fifth wheels 38 and 40 comprise a fixed wheel group. With the pivoting wheel group comprising three wheels 30, 32, and 34, the in-line skate 10 of this embodiment may be termed a competition in-line skate 10 as the traction and other performance characteristics that it would demonstrate would be most suitable for the performance requirements of a competition-level skater.

Under this arrangement, the pivoting wheel group can pivot with the carriage frame 26 relative to the main skate frame 12 to maintain contact with a ground surface (not shown) throughout a range of pivoting of the main skate frame 12 relative to the ground surface. As the astute observer will realize, the pivot axis 28 of the carriage frame 26 in this embodiment is anterior to the anterior end 20 of the skate boot 18, which has been found to extend the effective skating stroke as will be discussed in detail below.

Figure 2:
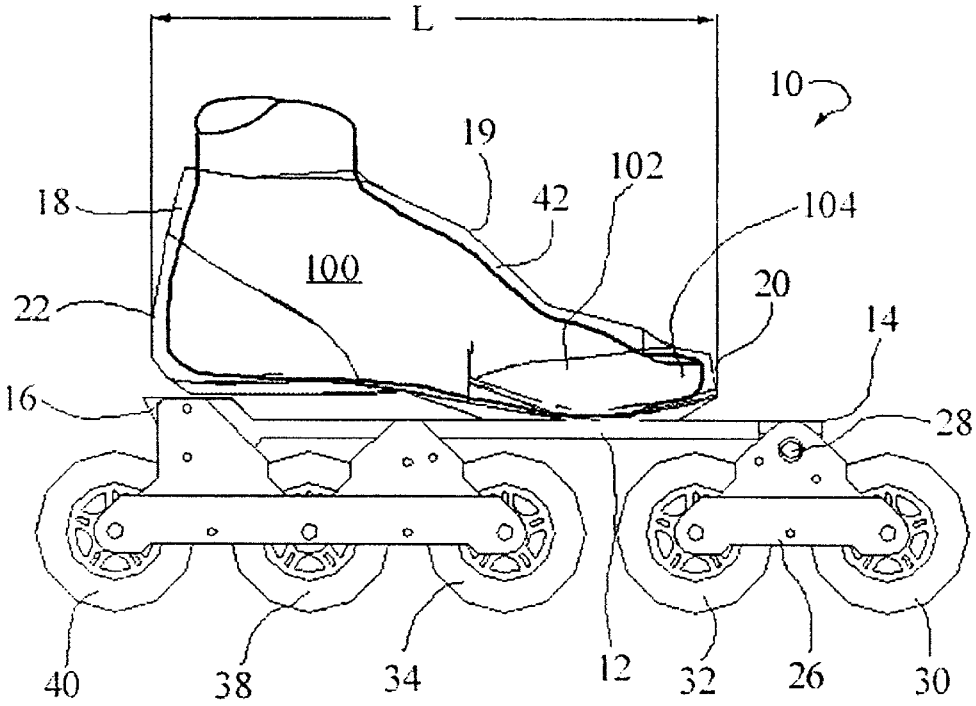
FIG. 2 is a view in side elevation of an alternative embodiment of an in-line skate embodying the present invention.

An alternative in-line skate is indicated again generally at 10 in FIG. 2. This embodiment again has first, second, third, fourth, and fifth wheels 30, 32, 34, 38, and 40. However, in this arrangement, the carriage frame 26 retains only first and second wheels 30 and 32 such that the pivoting wheel group comprises only those first and second wheels 30 and 32. Third, fourth, and fifth wheels 34, 38, and 40 are coupled to the main skate frame 12 to comprise the fixed wheel group. One again sees that the pivot axis 28 of the carriage frame 26 is anterior to the anterior end 20 of the skate boot 18 again for enabling an extended skating stroke. With five wheels 30, 32, 34, 38, 40 provided, the in-line skate 10 of this embodiment again may be considered a competition in-line skate 10.

In FIG. 2, where the shell 19 of the skate boot 18 is shown partially sectioned away, one sees the open inner volume 42, which is defined by the shell 19. In use, the skate boot 18 receives a skater's foot 100 into the open inner volume 42. The skater's foot 100 has a first metatarsophalangeal joint 102 about which the skater's first and largest toe 104 pivots. The inventor has discovered that providing an in-line skate 10 with a carriage frame 26 that pivots about a pivot axis 28 horizontally aligned with or anterior to the first metatarsophalangeal joint 102 provides a skater with an enhanced and lengthened skating stroke. Indeed, great advantage has been found to be achievable by locating the pivot axis 28 anterior to the anterior end 20 of the skate boot 18 as is illustrated in FIGS. 1 and 2.

On a typical foot, the first metatarsophalangeal joint 102 is located three-tenths of the overall length of the foot 100 from the tip of the first toe 104. Since the length L of the open inner volume 42 normally will approximate the length of the skater's foot 100, the pivot axis 26 preferably will be located coincident with or anterior to a reference point that is three-tenths of the overall length of the open inner volume 42 from the anterior end of the open inner volume 42 but not necessarily anterior to the anterior end 20 of the skate boot 18. As will be discussed more fully hereinbelow, the pivot axis 26 will be even more preferably coincident with or anterior to a reference point that is two-tenths of the overall length of the open inner volume 42 from the anterior end of the open inner volume 42, although not necessarily anterior to the anterior end 20 of the skate boot 18.

Figure 3:
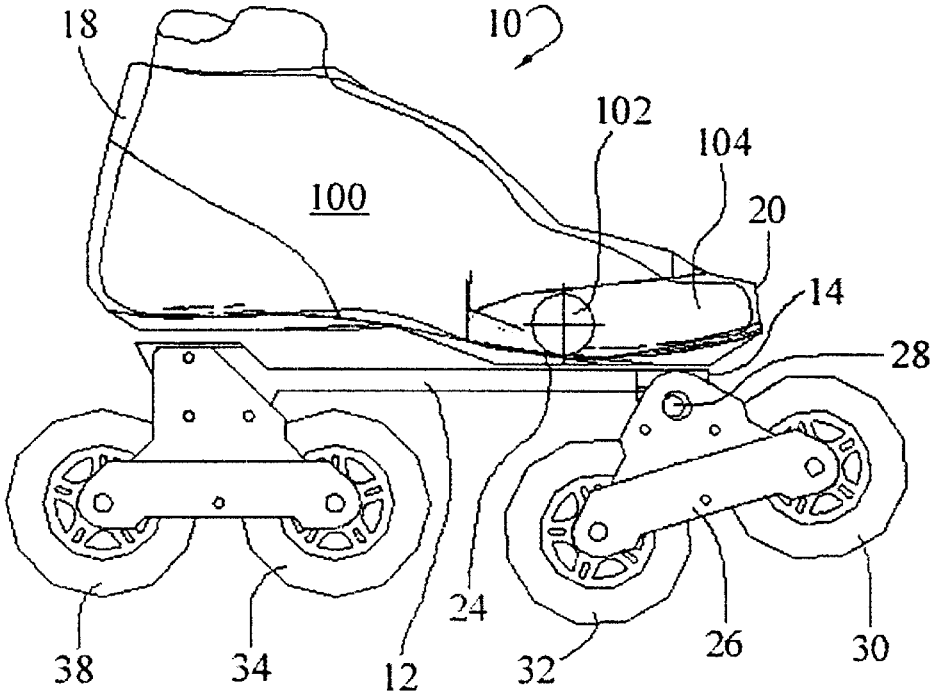
FIG. 3 is a view in side elevation of another alternative embodiment of the present invention for an in-line skate.

Such a possible construction of an in-line skate 10 is shown in FIG. 3. In this embodiment, first and second wheels 30 and 32 comprise the pivoting wheel group as they are rotatably mounted to the carriage frame 26. Third and fourth wheels 34 and 38 comprise the fixed wheel group as they are rotatably retained in a fixed position relative to the main skate frame 12. This recreational in-line skate 10 has just four wheels 30, 32, 34, and 38. The pivot axis 28 of the carriage frame 26 is located anterior to the reference point that comprises the first metatarsophalangeal joint 102 but posterior to the anterior end 20 of the skate boot 18.

The invention's aforedescribed manipulation of what may be considered the horizontal position of the pivot axis 28 certainly provides significant advantage over prior art in-line skates. However, the inventor has further discovered that prior art in-line skates could be improved on even more significantly by also altering the vertical position of the pivot axis 28. Prior art in-line skates with a pivoting front wheel structure historically have disposed the pivot axis 28 well below the sole 24 of the skate boot 18. With this, a careful consideration of the geometry of such skates will reveal that the pivot axis 28 actually moves rearward relative to the skater's foot 100 as the heel of the skate is lifted from the ground. This rearward movement further limits the effective length of the skating stroke.

Figure 4:
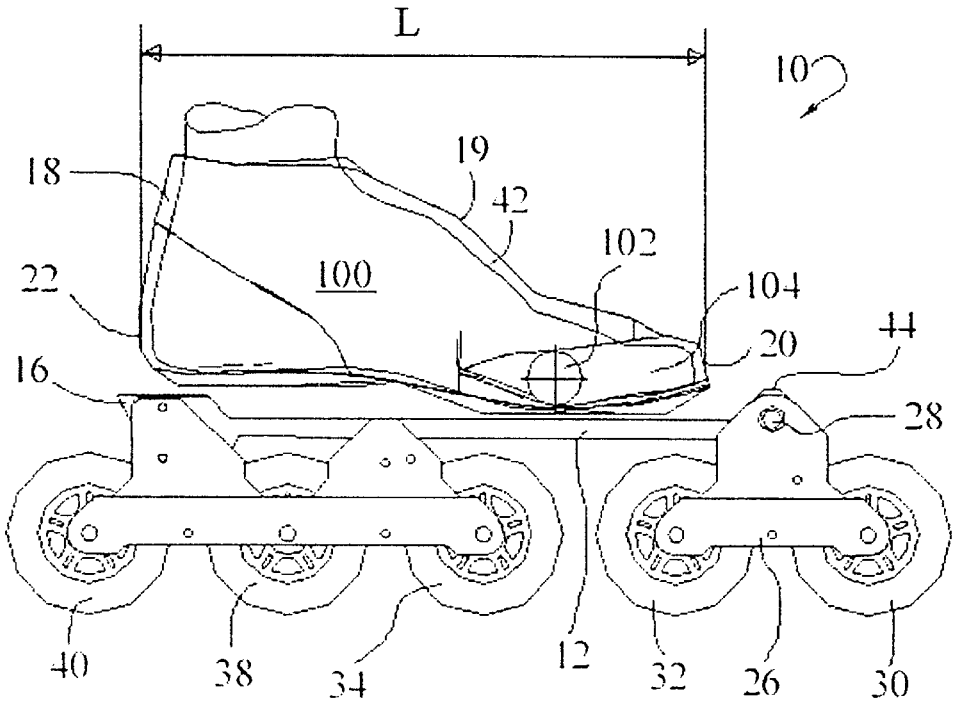
FIG. 4 is a view in side elevation of still another alternative embodiment of the present invention.
Figure 5:
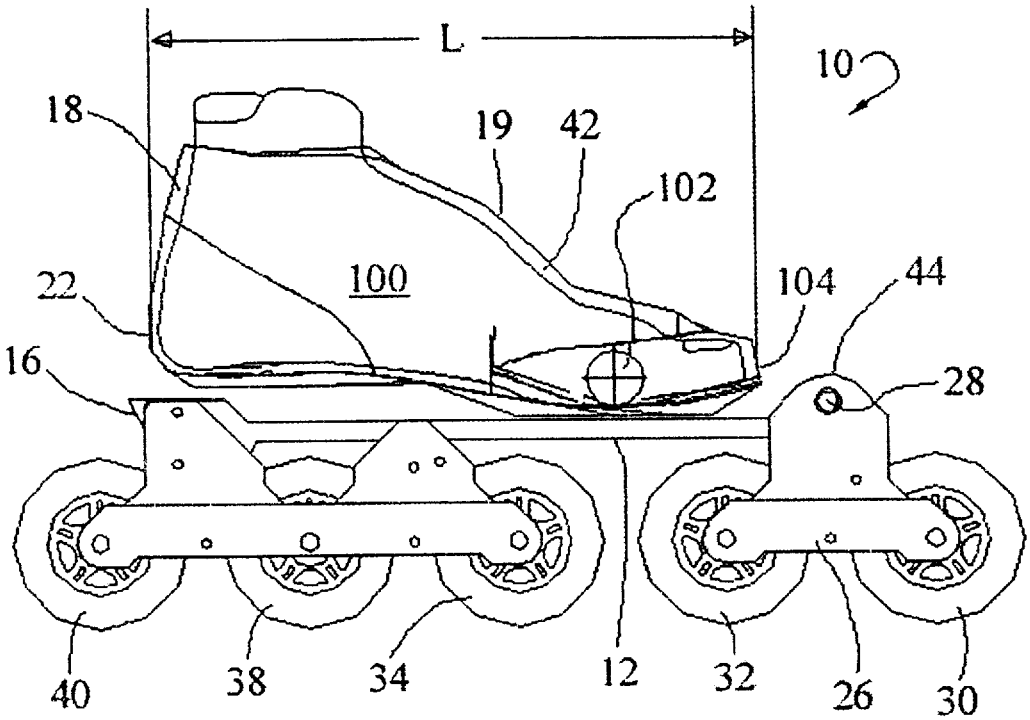
FIG. 5 is a view in side elevation of yet another embodiment of the present invention for an in-line skate.

Under this first embodiment of the present invention, however, the pivot axis 28 of the in-line skate 10 is displaced to a position nearly coincident with the upper edge of the main skate frame 12 as is shown in FIGS. 1, 2, and 3. As a result, the vertical position of the pivot axis 28 is immediately adjacent to the sole 24 of the skate boot 18. With this, the rearward distance that the pivot axis 28 moves as the main skate frame 12 is rotated relative to a ground surface can be minimized or eliminated.

Where possible, however, possibly greater advantage can be achieved by locating the pivot axis 28 even higher than the position shown in FIGS. 1, 2, and 3. For example, the pivot axis 28 could be approximately coincident with the sole 24 of the skate boot 18. This certainly could be accomplished in a number of ways. For example, as FIG. 4 shows, the main skate frame 12 could have an enlarged portion 44 disposed adjacent to the anterior end 14 of the main skate frame 12. The enlarged portion 44 could retain the pivot axis 28. Also, as FIG. 5 shows, the pivot axis 28 could be adjusted to be above the sole 24 of the skate boot 18, which may be considered distal to the sole 24 of the skate boot 18 relative to the wheels 30, 32, 34, 38, and 40 of the in-line skate 10.

Figure 6:
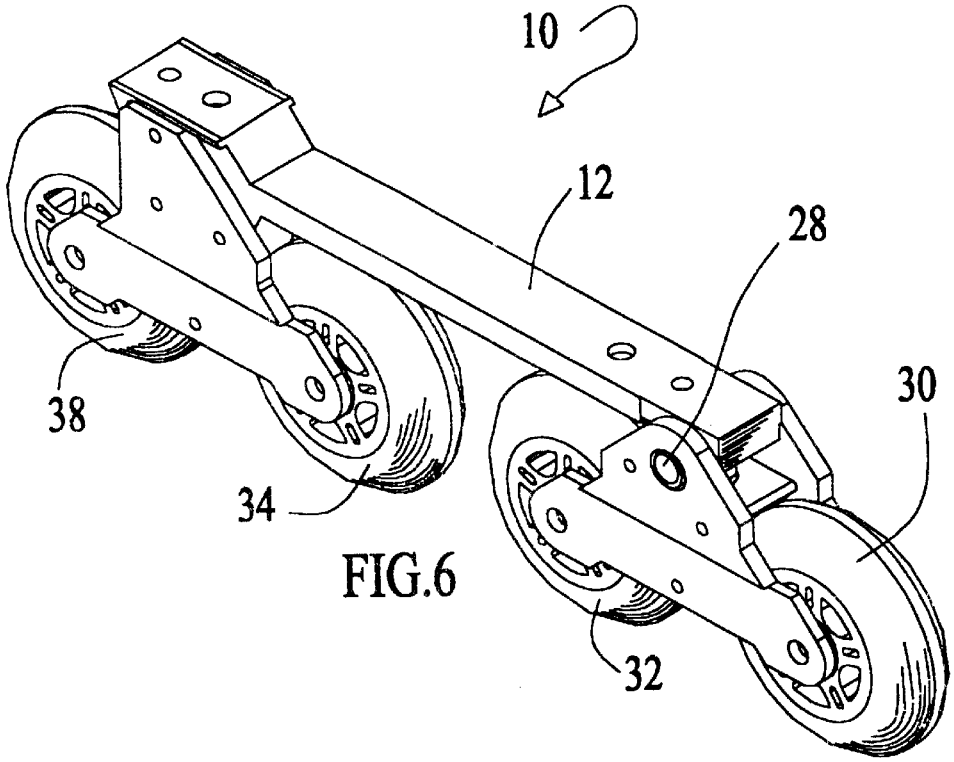
FIG. 6 is a perspective view of the in-line skate of FIG. 3 shown devoid of the skate boot.
Figure 7:
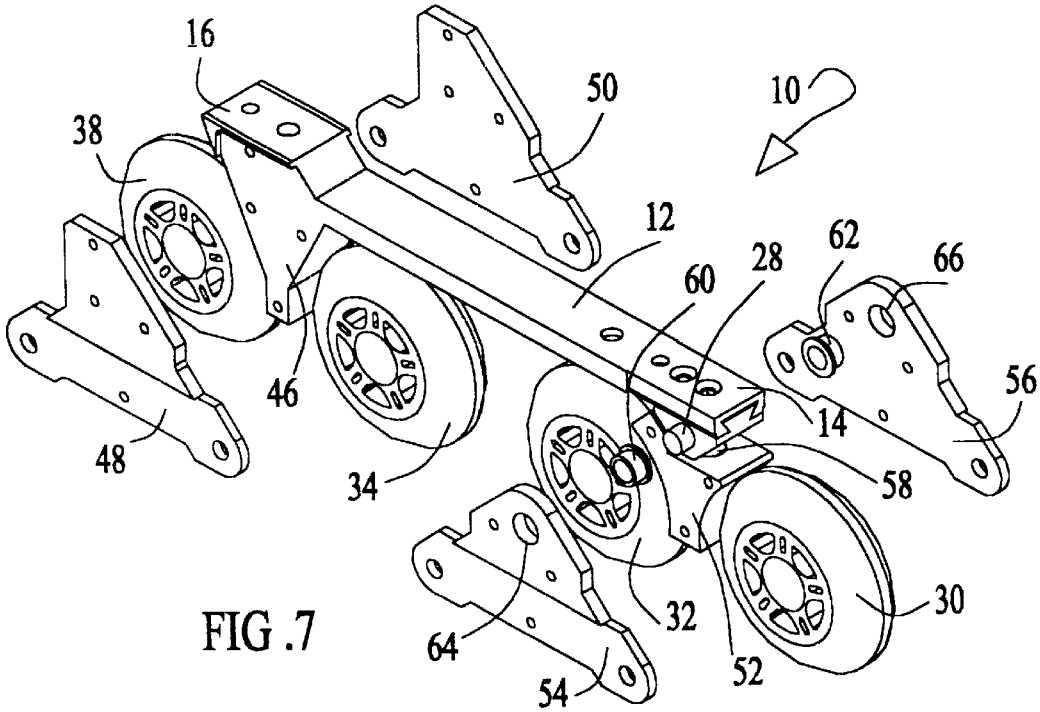
FIG. 7 is an exploded perspective view of the in-line skate of FIGS. 3 and 6.

For greatest clarity, the in-line skate 10 of FIG. 3 is shown in FIG. 6 devoid of the skate boot 18. Furthermore, FIG. 7 shows the in-line skate 10 of FIGS. 3 and 6 in an exploded view. In FIG. 7, one sees that the main skate frame 12 comprises an elongate member. As such, the main skate frame 18 provides a rigid supporting structure for all of the wheels 30, 32, 34, and 38 such that the wheels 30, 32, 34, and 38 maintain perfect alignment even with a pivoting of the carriage frame 26. This is an important advantage over prior art skates (not shown) that have mounted a pivoting carriage and a fixed carriage separately to a skate boot, which could permit the wheels 20, 32, 34, and 38 to become misaligned.

In any event, from FIGS. 6 and 7, one sees that the main skate frame 18 has a mounting block 46 that projects downwardly between the third and fourth wheels 34 and 38. Mounting plates 48 and 50 sandwich the mounting block 46 and the third and fourth wheels 34 and 38. The mounting plates 48 and 50 act as the means by which the third and fourth wheels 34 and 38 are retained relative to the main skate frame 12 by axles (not shown). The mounting plates 48 and 50 are fixed in place relative to the mounting block 46 by bolts (not shown) or any other appropriate fastening means.

In a similar manner, a spacer block 52 projects downwardly from adjacent to the anterior end 14 of the main skate frame 12 and is pivotally coupled thereto at the pivot axis 28. Mounting plates 54 and 56 sandwich the spacer block 52 and the first and second wheels 30 and 32. The mounting plates 54 and 56 thus act as the means by which the third and fourth wheels 30 and 32 are pivotally retained relative to the main skate frame 12 by axles (not shown). The mounting plates 54 and 56 are fixed in place relative to the spacer block 52 by bolts (not shown) or any other appropriate fastening means.

Bearings 60 and 62 surround the pivot axis 28 for enabling a smooth pivoting of the mounting plates 54 and 56. The pivot axis 28 projects from each side of the spacer block 52 an amount equal to the length of the bearings 60 and 62. The mounting plates 54 and 56 have axle apertures 64 and 66 into which the pivot axis 28 and the surrounding bearings 60 and 62 are received. Since a user might wish to adjust the horizontal location of the carriage frame 26 relative to the main skate frame 12, a plurality of attaching holes 55 can be provided on the main skate frame 12 to act as a means for adjusting the location of the carriage frame 26 relative to the main skate frame 12. Although not shown, the carriage frame 26 typically will be fixed in place by bolts in combination with the attaching holes 55.

To ensure that the pivoting wheel group is properly disposed for the beginning of each skating stroke, a biasing means in the form of a compression spring 58 may be interposed between the main skate frame 12 and the spacer block 52 for biasing the first and second wheels 30 and 32 into the disposition shown in FIG. 7. Of course, a wide variety of alternative biasing means will be obvious to one skilled in the art. For example, the inventor has further discovered that one could bias the carriage frame 26 toward the disposition of FIG. 7 by employing a solid axle relative to the first wheel 30 and a hollow or otherwise lighter axle relative to the second wheel 32. With this, with the pivot axis 28 centered between the wheels 30 and 32, the weight differential in the carriage frame 26 will induce the carriage frame to the disposition of FIG. 7. It is also possible, although not shown, to bias the carriage frame 26 by moving the pivot axis 28 rearward from its illustrated location centered between the first and second wheels 30 and 32.

Figure 8:
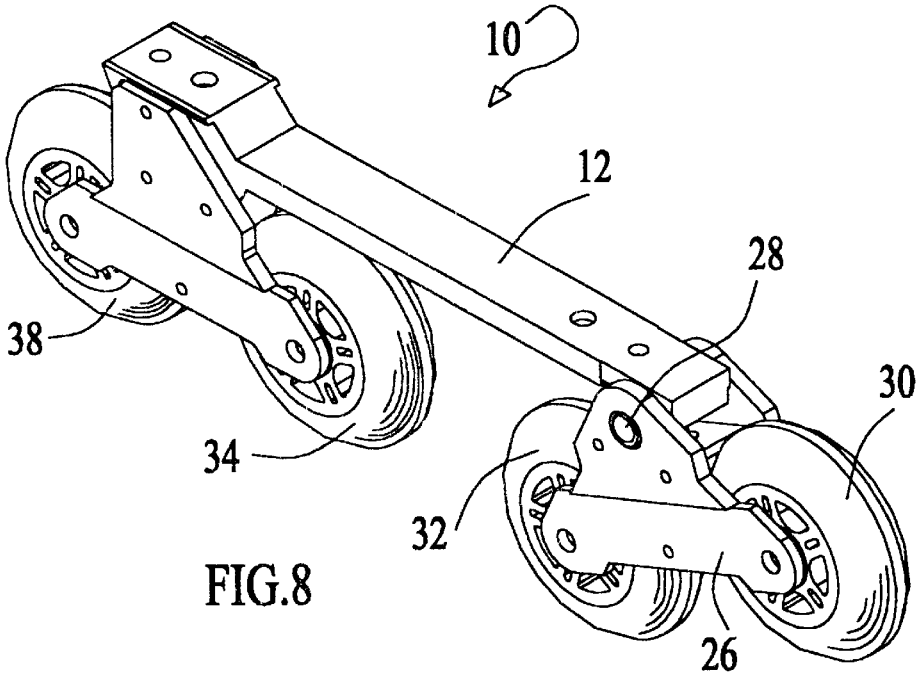
FIG. 8 is a perspective view of the in-line skate of FIGS. 3, 6, and 7 with the front wheels in a pivoted position.
Figure 9:
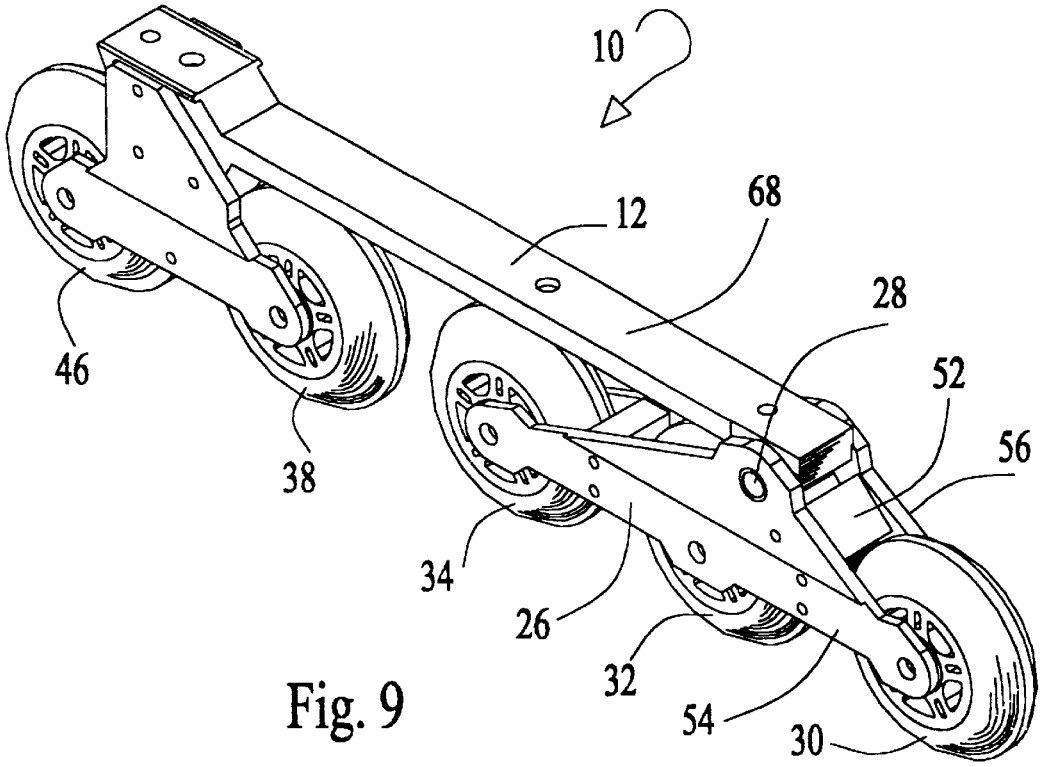
FIG. 9 is a perspective view of the in-line skate of FIG. I shown devoid of the skate boot.
Figure 10:
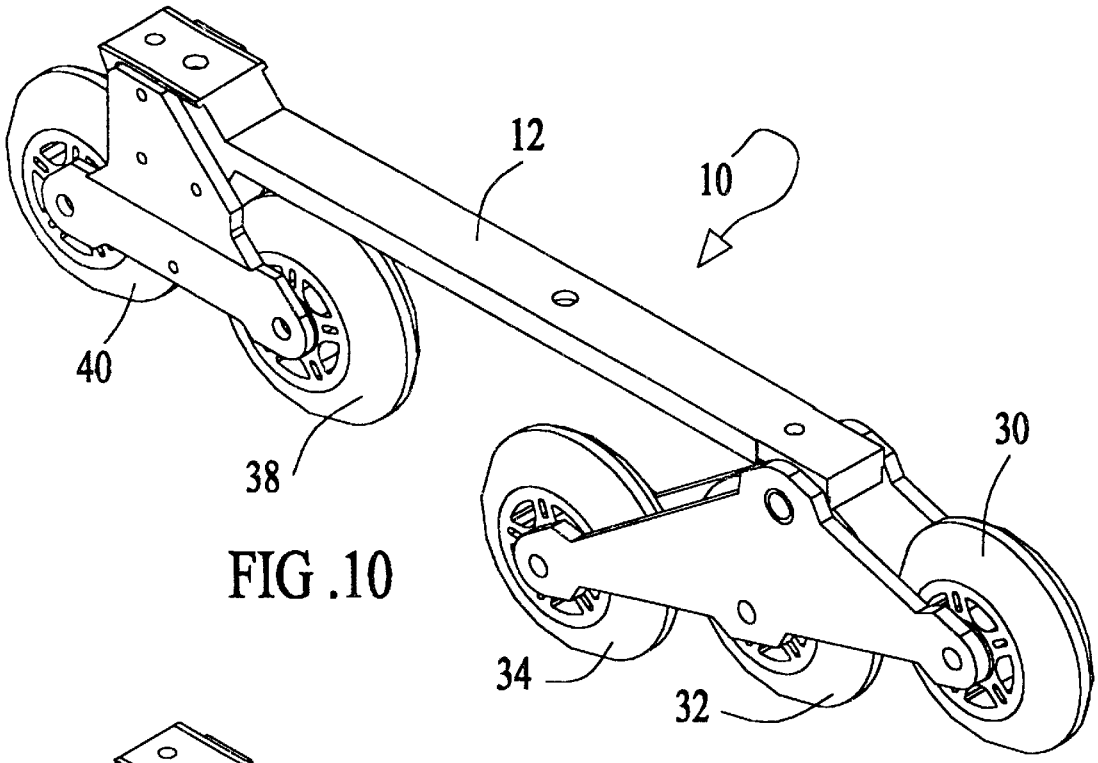
FIG. 10 is a perspective view of the in-line skate of FIGS. 1 and 9 with the front wheels in a pivoted position.
Figure 11:
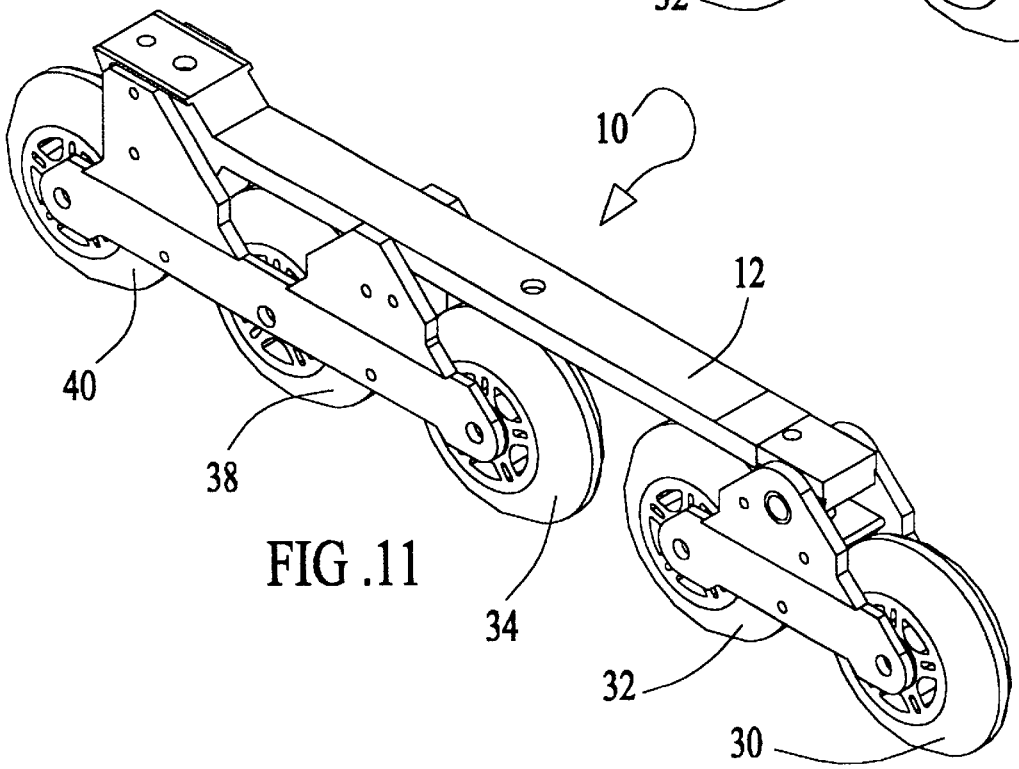
FIG. 11 is a perspective view of the in-line skate of FIG. 2 shown devoid of the skate boot.

FIG. 8 shows the in-line skate 10 with the first and second wheels 30 and 32 in a pivoted disposition relative to the main skate frame 12. Also, FIG. 9 shows the embodiment of the in-line skate 10 of FIG. I devoid of the skate boot 18. In this embodiment, another spacer block 68 is interposed between the mounting plates 54 and 56. Still further, FIG. 10 shows the in-line skate 10 with the first, second, and third wheels 30, 32, and 34 pivoted relative to the main skate frame 12. Still further, FIG. 11 shows the five-wheel embodiment of the in-line skate 10 of FIG. 2 devoid of the skate boot 18.

Figure 13:
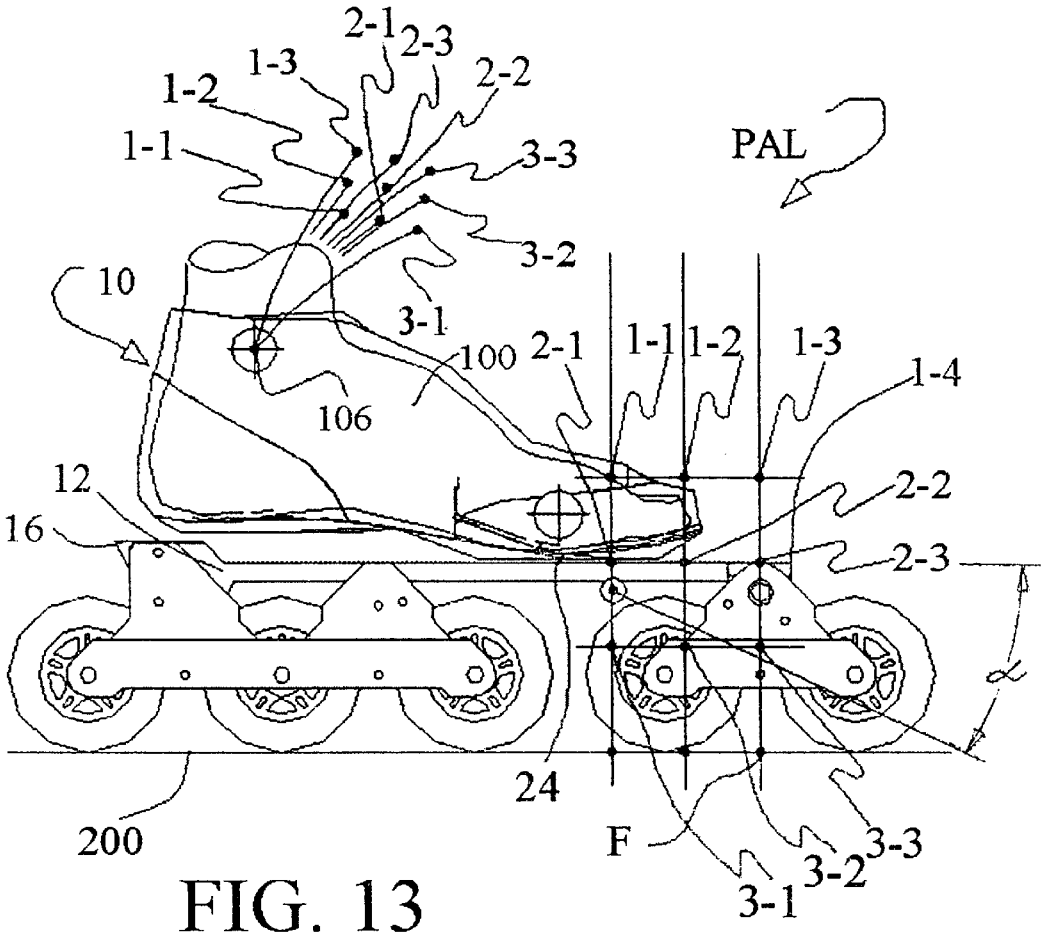
FIG. 13 is a view in side elevation of the in-line skate of FIG. 2 with possible pivot axis locations indicated.
Figure 14:
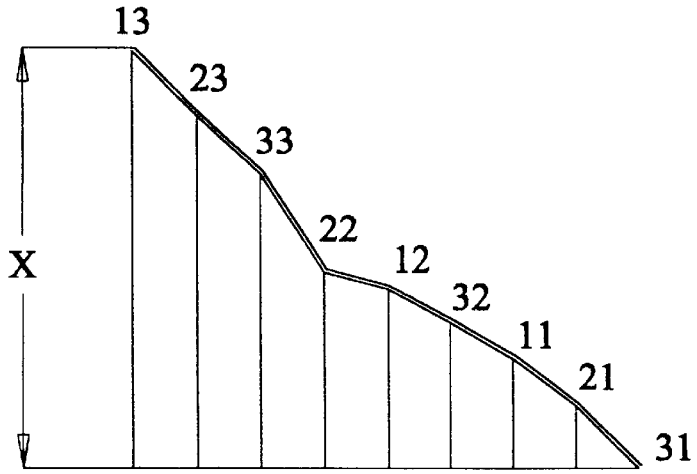
FIG. 14 is a graphical depiction of the differences in distance between the pivot axis of a subject's ankle and a reference point on a ground surface depending on the relative location of the pivot axis of the carriage frame.

FIGS. 13 and 14 together provide demonstrative evidence of the benefits to be achieved by locating the pivot axis 28 in the manner taught by the present invention. In FIG. 13, one sees what is essentially the in-line skate of FIG. 2 again with a skater's foot 100 disposed therein. Adjacent to the anterior end 14 of the main skate frame 12, FIG. 13 shows nine possible locations for the pivot axis 28 employing reference numbers 1-1,1-2, 1-3, 2-1, 2-2, 2-3, 3-1, 3-2, and 3-3. The pivot axis 106 of the subject's ankle is shown as it would be located with the main skate frame 12 flat relative to a ground surface 200.

Above the illustrated pivot axis 106, one sees for each possible location of the pivot axis 28 (with corresponding reference numbers) where the pivot axis 106 or ankle joint 106 would be if the main skate frame 12 were rotated a given angle relative to the ground surface 200 with the first and second wheels 30 and 32 maintaining contact with the ground surface 200. As the astute observer will realize, location 3-1, which is below the sole 24 of the skate boot 18 and not far in advance of the pivot axis 102 of the first metatarsophalangeal joint 102, would appear to yield the shortest effective increase in skating stroke length. On the other hand, location 1-3, which is well above the sole 24 of the skate boot 18 and well anterior to the anterior end of the skate boot 18, clearly yields the longest effective increase in skating stroke length.

The actual advantages in distance between a reference point F on the ground surface 200 and the pivot axis 106 of the subject's ankle are graphically shown in FIG. 14 where they are indicated at X. In one particularly dimensioned embodiment of the invention, the distance between the pivot axis 106 and the reference point F increased by a distance X of nearly three and one-third inches between the reference point 3-1 and the reference point 1-3. The reference point F may be considered the final push-off point of the pivoting in-line skate 10 and may be considered centered between the pivoting wheels 30 and 32 along a shared tangent thereto.

Based on this present understanding of the advantages of his invention, the instant inventor has determined that the pivot axis 28 would be located most preferably in what may be termed a Preferred Axis Location PAL area of FIG. 13. This PAL area is defined as the area between a vertical line drawn upwardly from the reference point 3-1 and a line extending along a downward angle a. The angle a has been determined to approximate most advantageously twenty-five (25) degrees below horizontal as determined when the in-line skate 10 is disposed in full contact with a ground surface.

In the preferred embodiment of FIG. 13, reference point 3-1 is located at least horizontally coincident with or anterior to a location of the first metatarsophalangeal joint 102, which typically will be at or anterior to a location 0.30 times the overall length of the skate boot 18 from the anterior end 20 of the skate boot 18. More preferably, though, the reference point 3-1 will be located at least horizontally coincident with or anterior to a location 0.20 times the overall length of the skate boot 18 from the anterior end 20 of the skate boot 18. Of course, under this present understanding of the invention, the reference point 3-1 will be located for greatest advantage anterior to the anterior end 20 of the skate boot 18.

As was mentioned previously, the vertical location of the reference point 3-1 also has a direct effect on the skating stroke. Accordingly, the preferred reference point 3-1 will be located at least vertically coincident with or above a position three-quarters of an inch below the sole 24 of the skate boot 18. More preferably, the reference point 3-1 will be located at least vertically coincident with or above a position one-half of an inch below the sole 24 of the skate boot 18. Most preferably based on the present analysis, the reference point 3-1 will be located substantially coincident with or above the sole 24 of the skate boot 18.

Figure 12:
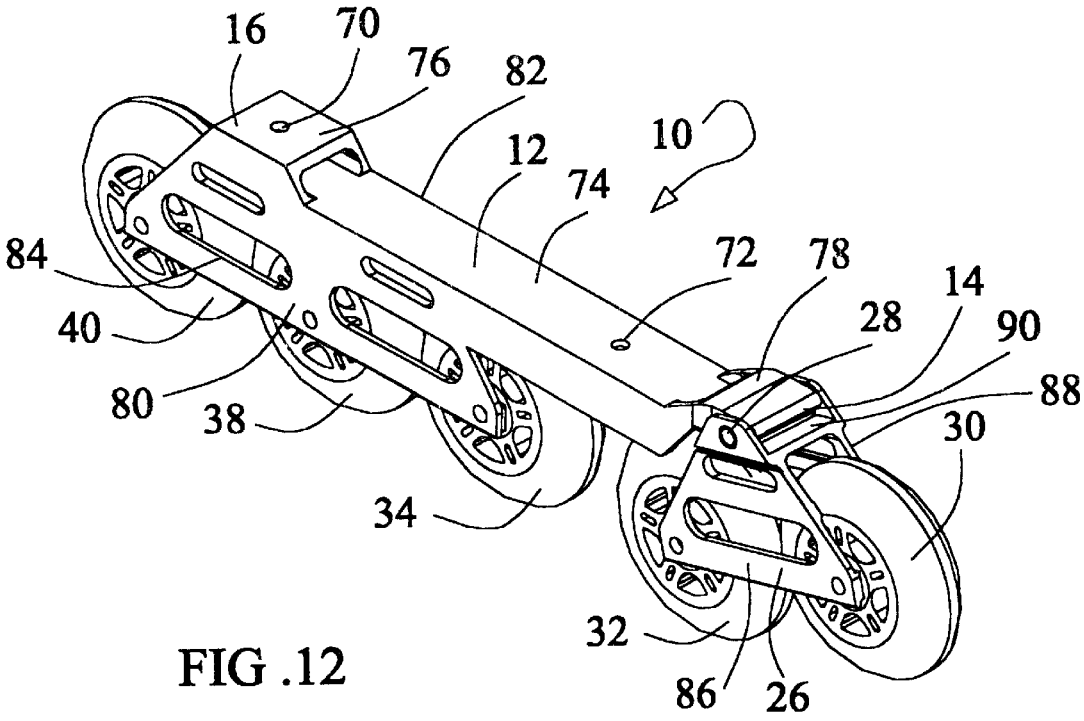
FIG. 12 is a perspective view of a main skate frame according to the present invention.

Looking next to FIG. 12, one sees a particularly preferred main skate frame 12 that provides a most advantageous location for the pivot axis 28. The main skate frame 12 has first and second fastening apertures 70 and 72 for fastening the main skate frame 12 to a skate boot (not shown). One major improvement depicted in the main skate frame 12 of FIG. 12 is that it is constructed as a one-piece design. It would presently appear preferable to form the unitary main skate frame 12 in an extrusion-and-cutting process. However, it should be clear that it would be well within the scope of the invention to form the structure in a stamping-and-bending process. With this, it can be exceedingly simple in manufacture yet extraordinarily rigid and durable in use.

The main skate frame 12 has a base plate 74 that is generally solid except for the second fastening aperture 72. A first side plate 80 is disposed in a plane generally perpendicular to the base plate 74 along a first side thereof, and a second, substantially identical side plate 82 is disposed in a plane generally perpendicular to the base plate 74 along a second side thereof. Consequently, the first and second side plates 80 and 82 are disposed in generally parallel planes, and the first and second side plates 80 and 82 and the base plate 74 together form what may be considered C-shaped channel. As one will appreciate, the first and second side plates 80 and 82 could extend slightly or even significantly above the base plate 74 distal to the third, fourth, and fifth wheels 34, 38, and 40 to cause the first and second side plates 80 and 82 and the base plate 74 to present an I-beam configuration.

The third, fourth, and fifth wheels 34, 38, and 40 are interposed between the first and second side plates 80 and 82, which essentially form the opposing jaws of the C shape. With this, the third, fourth, and fifth wheels 34, 38, and 40 contribute to the structural rigidity of the main skate frame 12. Although it is hidden in FIG. 12, also interposed between the first and second side plates 80 and 82 is a reinforcement plate that is disposed parallel to the base plate 74. In a manner illustrative of how the main skate frame 12 could be lightened, a plurality of cutouts 84 are disposed in the first and second side plates 80 and 82. Additional cutouts 84 could be disposed in the first and second side plates 80 and 82 and the base plate 74 provided that they do not detract from the required strength and rigidity of the structure.

An elevated mounting plateau 76 comprising a raised plate supported by a pair of side legs is disposed adjacent to the posterior end 16 of the main skate frame 12 for providing a heightened position for the first fastening aperture 70. In a similar manner, the anterior end 14 of the main skate frame 12 has an elevated retaining plateau 78 that rises above the base plate 74. By being located within the elevated retaining plateau 78, the pivot axis 28 is also disposed well above the base plate 74. With this and in light of the foregoing discussion of the benefits to be gained by advantageously locating the pivot axis 28, one will realize that the pivot axis 28 in FIG. 12 is in a particularly advantageous location. It is horizontally well anterior to where the toe of the skate boot would be located. Furthermore, it is vertically distal to where the sole of the skate boot would be relative to the first and second wheels 30 and 32 of the in-line skate 10.

Since the main skate frame 12 is formed by an extrusion-and-cutting process, one will appreciate that it is initially formed as a structure with a uniform cross section. That cross section is outlined by sides comprising the first and second side plates 80 and 82 and a top comprising what will ultimately form the elevated mounting plateau 76 the elevated retaining plateau 78. The base plate 74 will be disposed below and parallel to the top of the structure. Similarly, the reinforcement plate will be disposed below and parallel to the base plate 74. From this structure the ultimate main skate frame 12 will be cut. Certainly the main skate frame 12 could be formed from a variety of materials that would provide the required structural rigidity and durability. However, it presently appears preferable to form the main skate frame 12 and the carriage 26 from an aluminum alloy chosen for combined properties of strength, durability, and lightness. For example, 2024 and 7075 aluminum alloys presently appear desirable.

Much like the preferred main skate frame 12 of FIG. 12, the carriage 26 in FIG. 12 is also preferably formed by an extrusion-and-cutting process. It has a similar configuration to the main skate frame 12. First and second side plates 86 and 88 are formed integrally with a base plate 90. As with the main skate frame 12, the first and second side plates 86 and 88 are generally parallel to one another and perpendicular to the base plate 90. In the carriage 26, however, a portion of each of the first and second side plates 86 and 88 extends from base plate distal to the base plate 90 relative to the first and second wheels 30 and 32. With this, that portion of each side plate 86 and 88 acts as a means for retaining the pivot axis 28 above the sole of a skate boot (not shown) that is attached to the main skate frame 12 and well anterior to the toe of any such skate boot.

Figure 15:
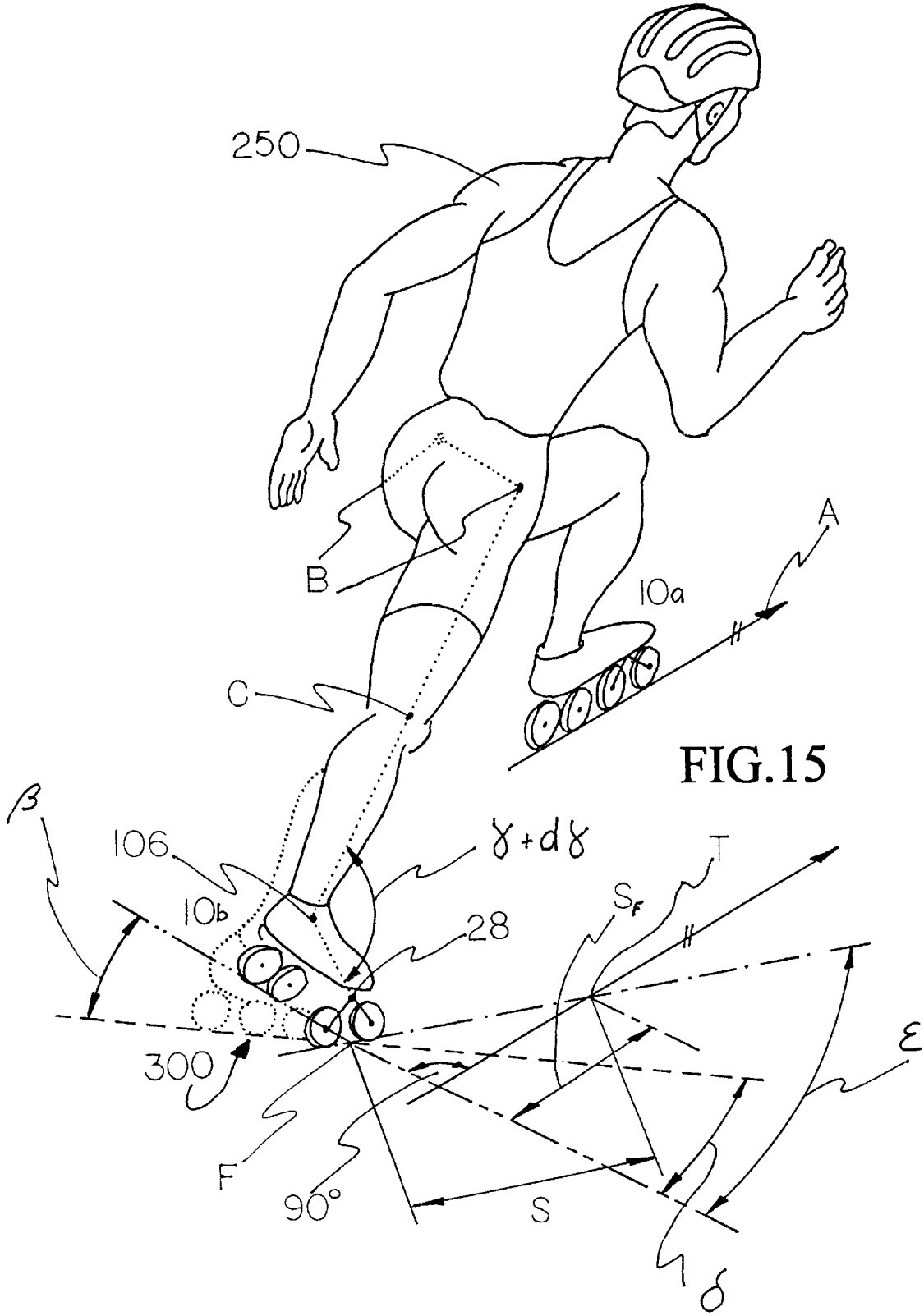
FIG. 15 is a perspective view of a skater wearing a pair of in-line skates according to the present invention depicting the advantages to be gained by the location of the present invention's pivot axis.

Although the foregoing discussion certainly makes clear that measurable advantages are to be gained by the present invention's advantageous locating of the pivot axis 28 of the carriage 26, one can gain an even more particular understanding of the nature of the advantages gained by reference to FIG. 15 and the ensuing discussion and formulae. In FIG. 15, an in-line skater 250 wears first and second in-line skates 10*a* and 10*b* according to the present invention. The first in-line skate 10*a* is in an initial portion of the skating stroke while the second in-line skate 10*b* is disposed as it would be in a final portion of the skating stroke. Adjacent to the second in-line skate 10*b*, one sees in ghost format a prior art, non-pivoting in-line skate 300 as it would be oriented at the end of the skating stroke. The coincident location of the in-line skates 10*b* and 300 in FIG. 15 may be considered to be where the advantages gained by the present invention become manifest in extending the skating stroke as herein described.

In FIG. 15, the line A indicates the direction of forward motion. The location of the in-line skater's 250 hip joint is indicated at B, and his knee joint is shown at C. The angle $\beta$ is what may be termed a space angle between a line drawn from the point F through the most distal point on the rearmost wheel of the in-line skate 10*b* or 300. With a pivoting in-line skate 10*b*, the point F may be considered centered between the pivoting wheels 30 and 32 along a shared tangent thereto. For the prior art skate 300, the point F may be considered the last point on the edge of the foremost wheel to leave the ground surface.

An angle $\gamma$ (not shown) is the angle between the in-line skater's 250 foot and shinbone with a prior art, non-pivoting in-line skate 300 when the skate is in a push-off position as shown in FIG. 15. The angle $\gamma+d\gamma$ in FIG. 15 represents the aforementioned angle $\gamma$ plus the additional extension $d\gamma$ provided to that angle $\gamma$ by providing the pivoting front carriage 26 according to the present invention. As one will see in FIG. 15, with the in-line skates 10*a* and 10*b* according to the present invention, the hip joint B, knee joint C, and ankle joint 106 are able to achieve an aligned configuration.

Figure 16:
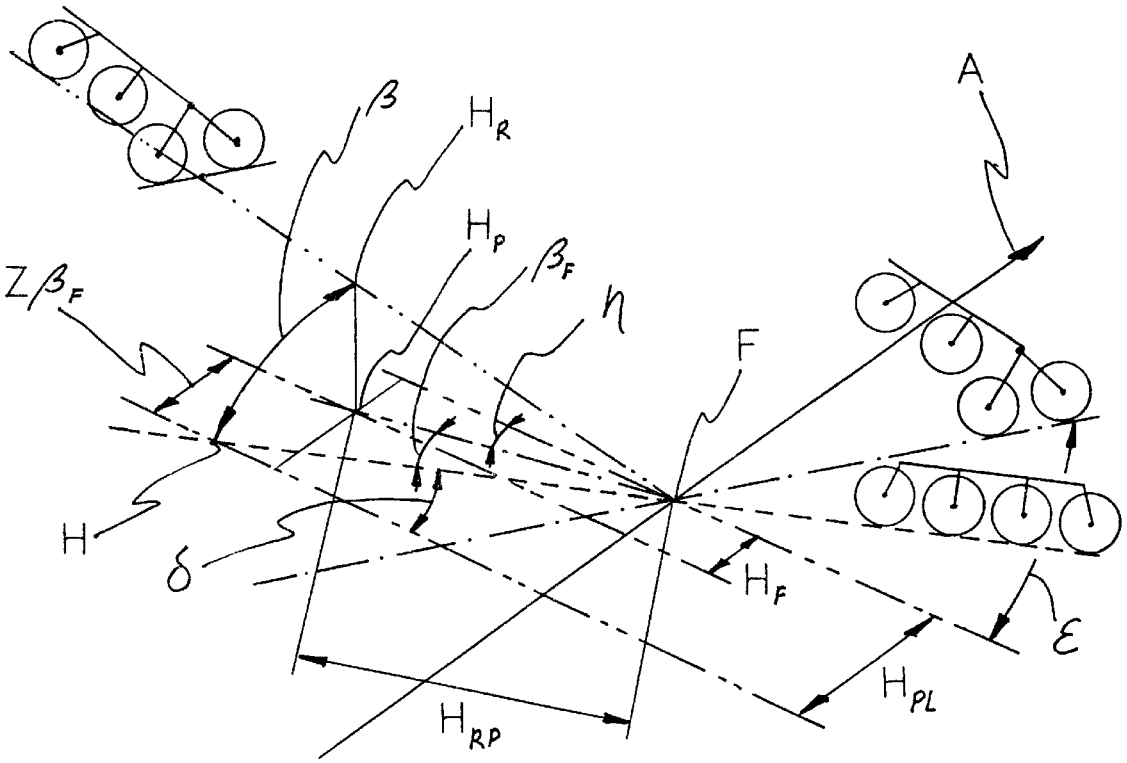
FIG. 16 is a schematic further depicting the advantages to be gained by locating the pivot axis according to the present invention.

One will appreciate that there is a forward gain in the position of the in-line skater's 250 ankle joint 106 along the line of travel A, which results in part from the angle $\beta$. In FIG. 16, one sees that this distance $Z\beta_f$ equals the result of subtracting the distance $H_F$ from the distance $H_{PL}$. $H_{PL}$ is the distance between points H and F along the direction of travel A, and it can be calculated as $(\sin\delta)(DH)$ where DH is the distance between the points H and F. $H_F$ equals the product of $(\sin\eta)(H_{RP})$ where the angle $\eta$ equals the angle $\delta$ minus the angle $\beta_F$. Angle $\beta_F$ is a projection of the space angle $\beta$ in a horizontal plane.

$H_{RP}$ is a projection of the distance between the point $H_R$ and the point F in a horizontal plane. Point H is the location of the most distal point on the rearmost wheel on the prior art, non-pivoting in-line skate 300. Point $H_R$ is the location of that same point on a pivoting in-line skate 10*b* according to the present invention. Point $H_P$ is the projection of point $H_R$ in a horizontal plane.

In an attempt to produce greatest clarity, the plurality of lines in FIG. 16 are coded. The track of the non-pivoting skate 300 is indicated by a line of dashes of consistent length. The track of the pivoting skate 10*b* is indicated by a line of alternating dots and long dashes. The direction of forward motion A is indicated by a solid line. The direction perpendicular to the direction of forward motion A is indicated by a line of two short dashes interposed between long dashes. The direction of a rotated tangent of the pivoting in-line skate 10*b* around point F by the amount of the space angle $\beta$ is indicated by a line of two dots interposed between long dashes. Finally, the top projection of the rotated track of the pivoting in-line skate 10*b* around point F in a horizontal plane is indicated by a sequential series of a long dash, a short dash, and a dot.

In any event, one will further realize that the ankle joint 106 is moved forward an additional distance by the increase $d\gamma$ in the angle $\gamma$. This distance can be readily calculated in a similar manner as the distance $Z\beta_f$ was calculated above from the values given by $d\gamma_f$, the distances between the ankle joint 106 and the pivot axis 28 and between the ankle joint 106 and F, the orientation of the ankle joint 106 relative to the knee joint C, and the angles $\delta$ and $\epsilon$.

There is a further distance, S, to be considered, which is the additional distance that the present in-line skate 10 is able to travel along a ground surface due to the pivoting of the first and second wheels 30 and 32. One will appreciate that this distance S is a factor of the in-line skater's 200 velocity dV and the increased stroke time dT. The distance S can be given as the product of (dV)(dT). The distance S has a forward component $S_F$, which is equal to $(\sin\epsilon)(S)$. With this distance $S_1$ one sees that the in-line skate 10*b* of the present invention will actually have a final skating stroke position at the point T in FIG. 15. The in-line skates 300 and 10*b* are shown generally aligned in FIG. 15 merely to enable a clear comparison of the previously-described angles.

With this, the cumulation of the distance gains by the pivoting in-line skate 10 according to the present invention can be symbolized by E, which is the result of adding the variable and interrelated improvements $(Z\beta_f)+(Ld\gamma_f)+(X)+(S)$ where X is the distance given in FIG. 14. The astute observer will realize that the distances $(Z\beta_f)+(Ld\gamma_f)+(X)+(S)$ are indications of the gains that are available to one who makes use of the present invention. Of course, the corresponding dimensional gains that can be realized by each individual skater will depend on a plurality of factors including size, ability, strength, and effort.

In light of the advantages that they produce, it will certainly be appreciated that the enlarged portion 44 of FIGS. 4 and 5 and the elevated retaining plateau 78 of FIG. 12 are both viable structures for adjusting the vertical and horizontal locations of the pivot axis 28. However, at least in certain circumstances, it may be argued that such structures are amenable to improvement in that they add to the bulk and weight of the in-line skate 10. Furthermore, such structures impose practical limitations on where the pivot axis 28 can be located.

Advantageously, the inventor has conceived of even further embodiments of the invention that are able to manipulate the location of the pivot axis 28 while eliminating all need for structures such as the enlarged portion 44 and the elevated retaining plateau 78 that would otherwise be necessary for adjusting the vertical and horizontal locations of the pivot axis 28. In each such embodiment, the in-line skate 10 incorporates a pivoting mechanism that acts as a means for creating a physically displaced effective pivot axis, with the pivot axis again indicated at 28. As its name would suggest, the pivoting mechanism for creating a physically displaced effective pivot axis enables the in-line skate 10 to create an effective pivot axis 28 that is physically displaced from the moving contacts between the main skate frame 12 and the carriage frame 26. Indeed, these embodiments of the invention can allow the effective pivot axis 28 to be moved to locations physically displaced from, preferably vertically above, the carriage frame 26 and the main skate frame 12 without requiring that actual physical structure be located at the location of the effective pivot axis 28.

Figure 17:
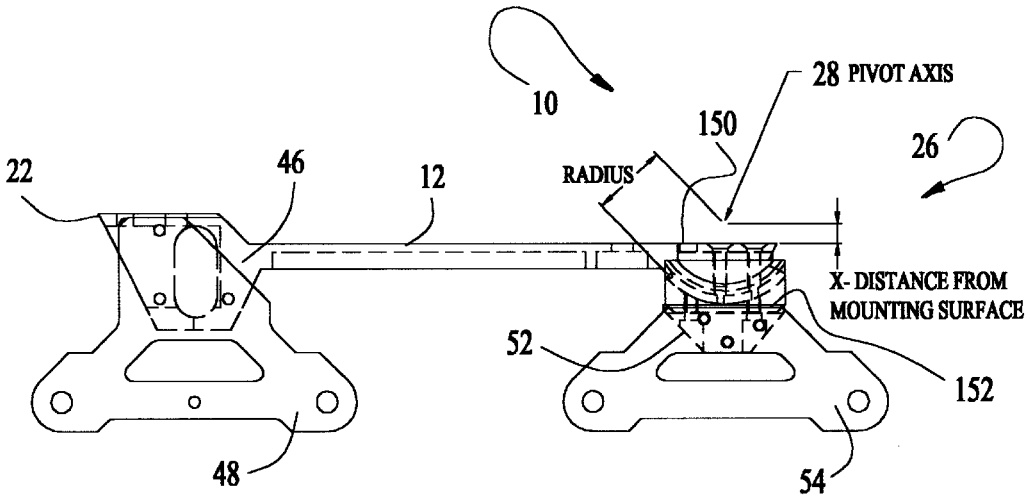
FIG. 17 is a view in side elevation of an alternative embodiment of the in-line skate.
Figure 18:
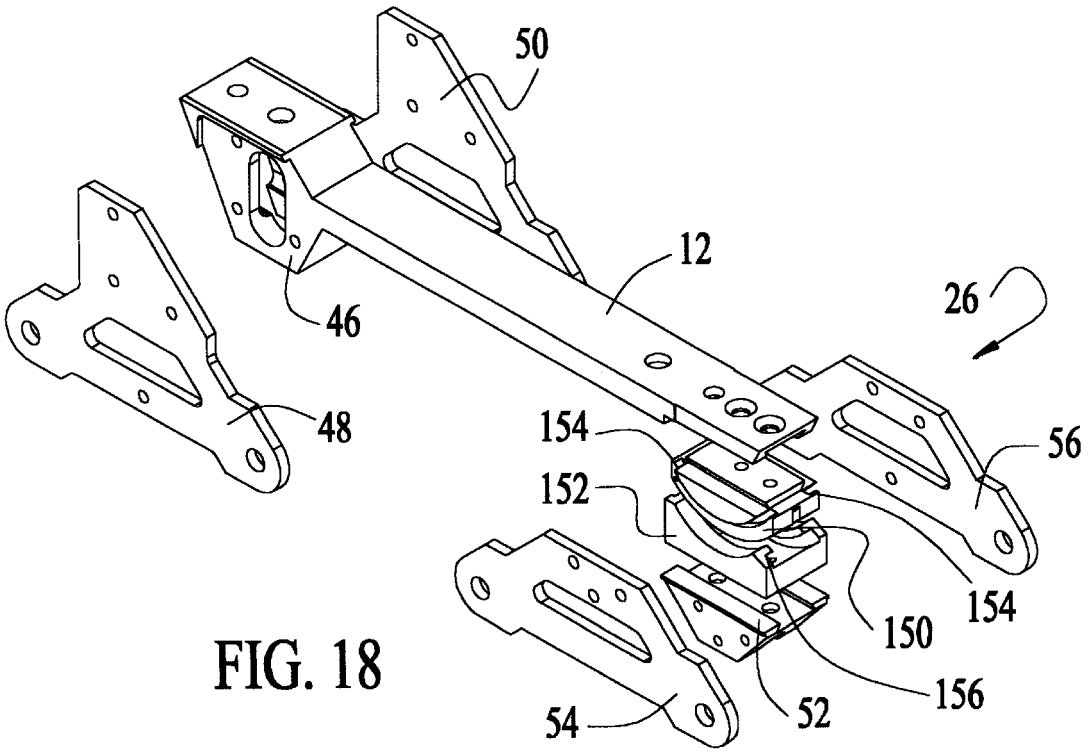
FIG. 18 is an exploded perspective view of the in-line skate of FIG. 17.

A first such embodiment of the invention is shown in side elevation in FIG. 17 and then in an exploded perspective view in FIG. 18. There, the carriage frame 26 is pivotally coupled to the main skate frame 12 by a slidable engagement between a base member 150 with an external curve and a pivot block 152 with an internal curve. The base member 150 is fixed to or integrally formed with the main skate frame 12 while the pivot block 152 is fixed to or formed integrally with the spacer block 52 between the mounting plates 54 and 56. The external curve of the base member 150 matches the internal curve of the pivot block 152 so that the two can slide easily relative to one another. Also, the base member 150 has a pair of engaging shoulders 154 that slidably mate with an arcuate C-channel 156 on the pivot block 152. With this, the pivot block 152 is securely yet slidably coupled to the base member 150. To allow the base member 150 and the pivot block 152 to slide most easily relative to one another, lubrication may be interposed therebetween. Alternatively, either or both of the base member 150 and the pivot block 152 can be coated with a low friction material, such as low friction plastic.

Under this arrangement, as FIG. 17 indicates most clearly, the carriage frame 26 is pivotally coupled to the main skate frame 12 to pivot about an effective pivot axis 28 that is displaced from the actual arc about which the two are coupled. Indeed, this structure allows the effective pivot axis 28 to be located displaced above the main skate frame 12 as was accomplished by the enlarged portion 44 and the elevated retaining plateau 78 of earlier embodiments while eliminating the weight and bulk associated therewith. Even more advantageously, the location of the effective pivot axis 28 can be manipulated by an adjustment of the radius of curvature of the curves on the base member 150 and the pivot block 152 and, possibly, by an adjustment of the orientation of the curves.

Figure 19:
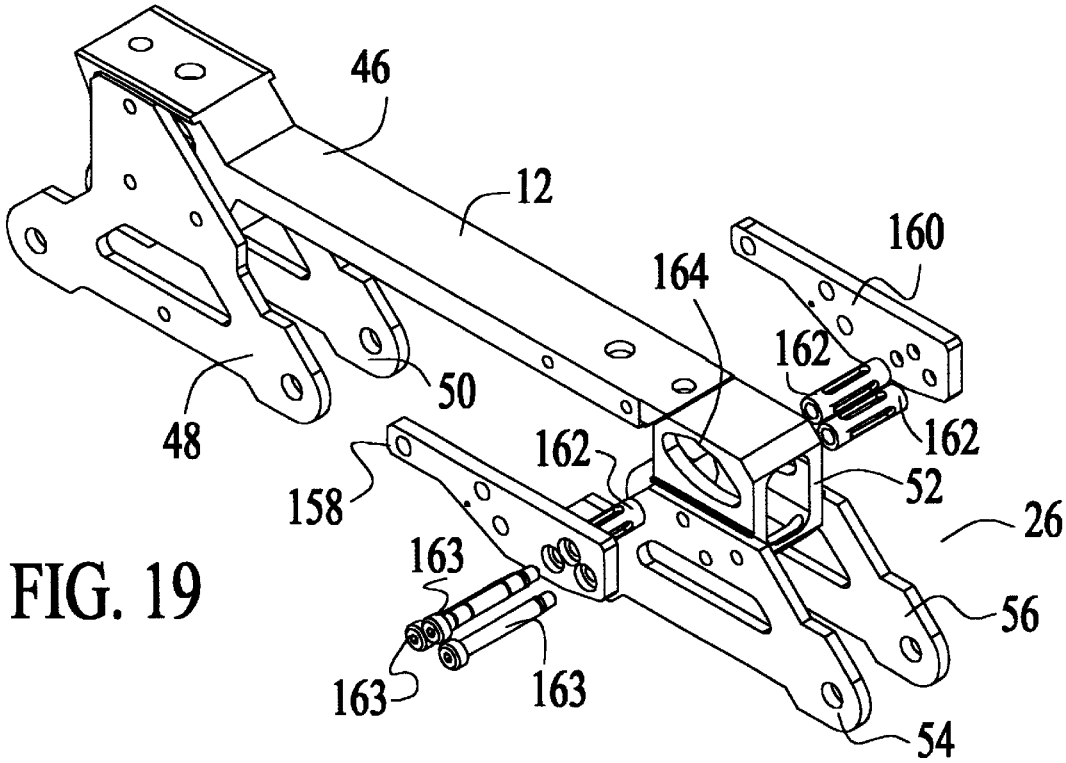
FIG. 19 is a partially exploded perspective view of another alternative embodiment of the in-line skate.

An alternative means for creating a physically displaced effective pivot axis 28 is depicted in the exploded perspective view of FIG. 19. There, the spacer block 52 again is interposed between the mounting plates 54 and 56. However, in this embodiment, first and second pivot support plates 158 and 160 are fixed to opposite sides of the main skate frame 12. Indeed, the first and second pivot support plates 158 and 160 are integrally formed with the main skate frame 12 from a single piece of material. With this, the first and second pivot support plates 158 and 160 are disposed on opposite sides of the spacer block 52 to retain the pivot block 52 and thus the carriage frame 26 in a pivoting relationship relative to the main skate frame 12. To accomplish this pivoting relationship, the pivot block 52 has an arcuate passage 164 extending laterally therethrough. Cylindrical pivot support rollers 162 are rotatably retained on axles 163. Each axle 163 passes through the arcuate passage 164 and has first and second ends received in corresponding apertures in the first and second pivot support plates 158 and 160 respectively. With this, the pivot support rollers 162 can rotate about their respective axles 163 thereby to roll along the arcuate passage 164.

In this embodiment, three pivot support rollers 162 with corresponding axles 163 are provided. The pivot support rollers 162 and axles 163 are disposed in a triangular arrangement that has a given effective height measured from the upper peripheral edge of the what may be considered the upper pivot support roller 162 of the triad and a tangential line along the lower peripheral edges of what may be considered the base pivot support rollers 162. The arcuate passage 164 is just slightly wider along the curve of the arcuate passage than the height of that triangle in which the pivot support rollers 162 are arranged. With this construction, the carriage frame 26 can be pivoted relative to the main skate frame 12 about an effective pivot axis 28 that is displaced above the main skate frame 12 and the carriage frame 26. As the carriage frame 26 is so pivoted, the pivot support rollers 162 will tend to roll along the peripheral surfaces of the arcuate passage 164.

In an alternative embodiment, which is not expressly shown in the drawings, the pivot support rollers 162 could have substantially identical outside diameters and the arcuate passage 164 could be just slightly wider than the diameters of the pivot support rollers 162. With this, the invention could incorporate two or more pivot support rollers 162 configured to mirror the shape of the arcuate passage 164 to allow the carriage frame 26 to pivot relative to the main skate frame 12 by having the pivot support rollers 162 roll and possibly slide within the arcuate passage 164.

Figure 20:
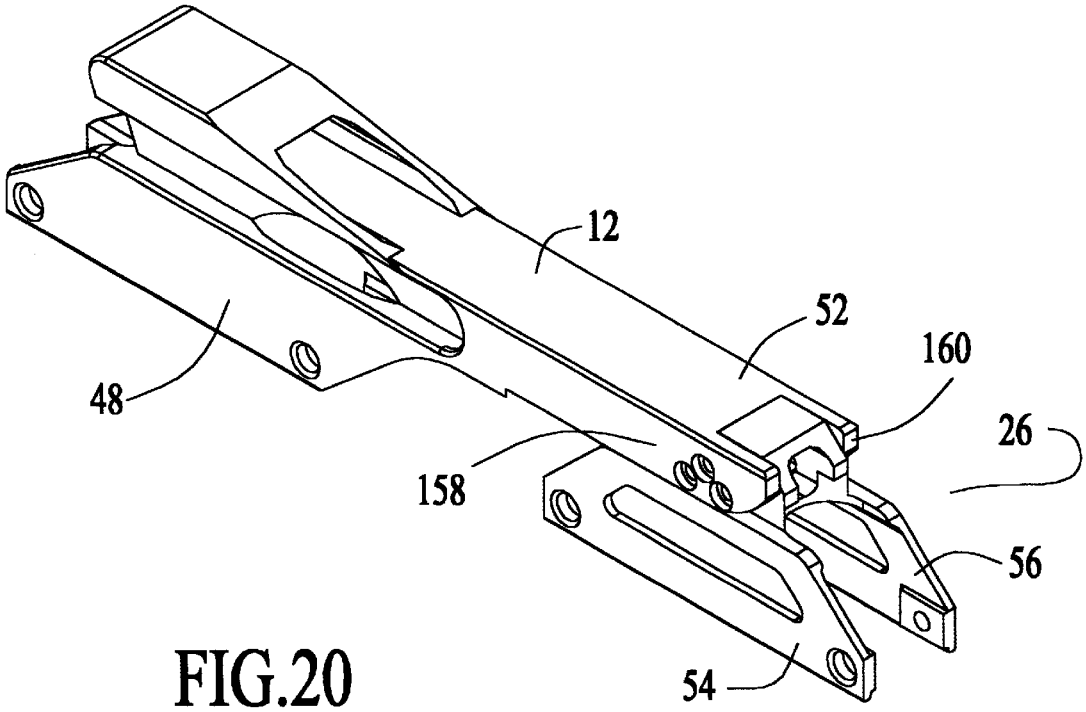
FIG. 20 is a perspective view of still another embodiment of the in-line skate.

Still another embodiment of the invention is shown in FIG. 20. There, the pivoting of the carriage frame 26 relative to the main skate frame 12 is accomplished in substantially the same way as in FIG. 19. However, in this case, the first and second pivot support plates 158 and 160 are formed integrally with the main skate frame 12. With this, the first and second pivot support plates 158 and 160 effectively comprise sides to the main skate frame 12. The spacer block 52 is again interposed between the first and second pivot support plates 158 and 160.

To still greater advantage, the present inventor has devised of what may be considered a preferred manner of eliminating all play between the carriage frame 26 and the main skate frame 12 so that the two can be moved relative to one another smoothly and with no undesirable up and down or other disadvantageous movement therebetween. One such still further embodiment is depicted in FIG. 21 in a partially exploded view and in a cross-sectional view in FIG. 22 taken along the line 22—22 in FIG. 21.

Figure 21:
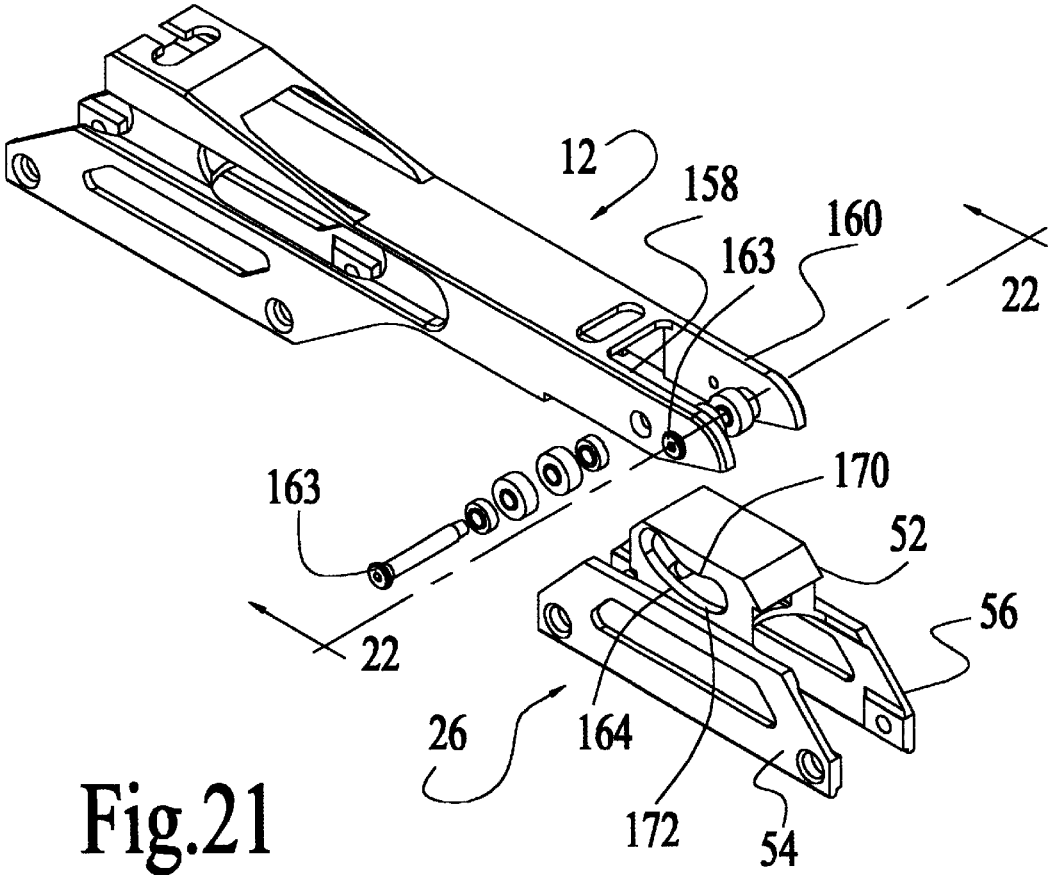
FIG. 21 is a partially exploded perspective view of a further embodiment of the in-line skate.
Figure 22:
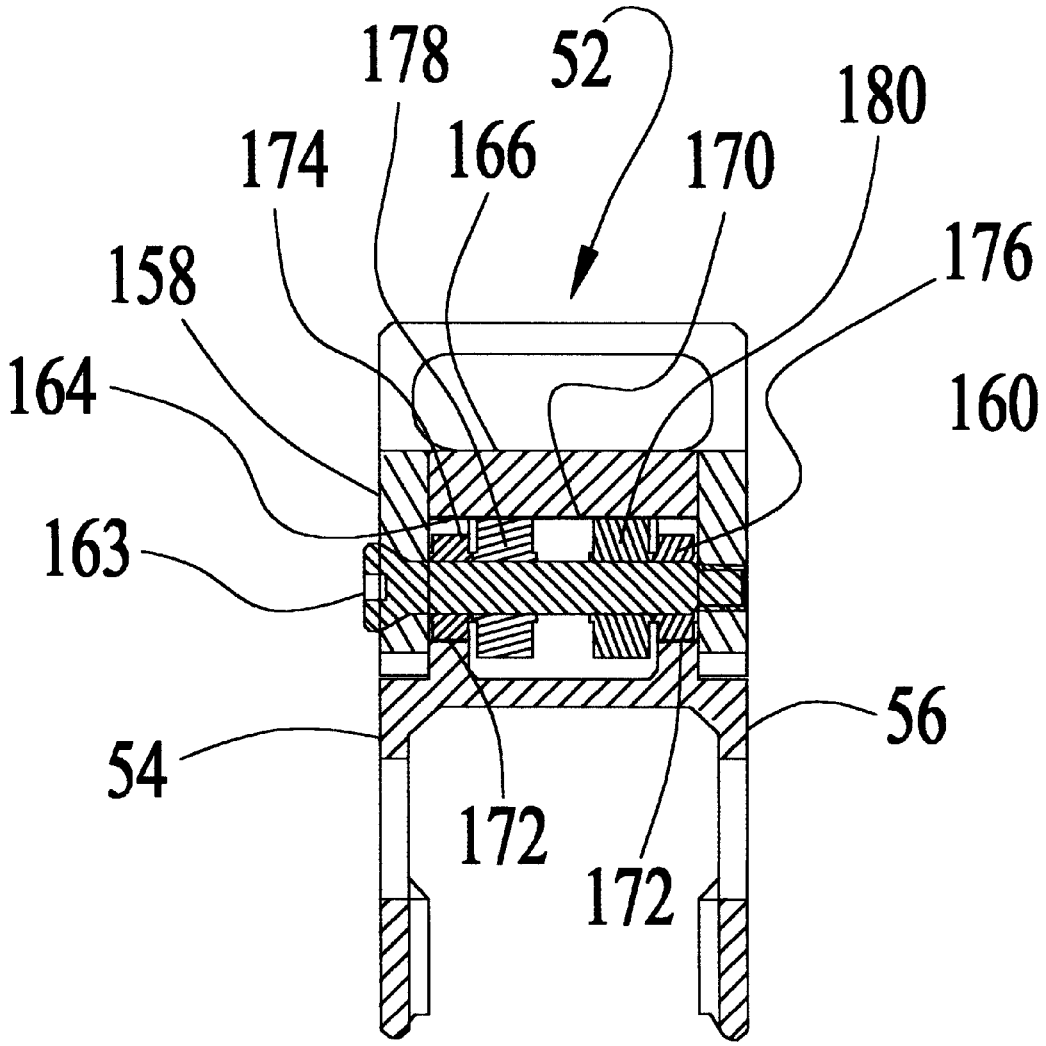
FIG. 22 is a cross section taken along the line 22—22 in FIG. 21 as main skate frame would be coupled to the carriage frame.

In the embodiment of FIGS. 21 and 22, the in-line skate 10 advantageously eliminates all play between the carriage frame 26 and the main skate frame 12 by an opposing bearing roller arrangement wherein upper and lower surface engaging rollers are disposed on a single axle with at least one upper surface engaging roller contacting an upper boundary surface on the carriage frame 26 but not a lower engaging surface and at least one lower surface engaging roller contacting a lower boundary surface on the carriage frame 26 whereby no roller contacts both the upper and lower boundary surfaces. With this, the upper and lower surface engaging rollers can be sized to ensure a tight fit against the upper and lower engaging surfaces on the carriage frame 26 thereby allowing the carriage frame 26 to pivot smoothly relative to the main skate frame 12 with no disadvantageous play therebetween.

More particularly described, the in-line skate of FIGS. 21 and 22 again incorporates an arcuate passage 164 that passes through the walls of the pivot block 52. Axles 163 again pass through the arcuate passage 164 in the pivot block 52 and have first and second ends retained by the first and second pivot support plates 158 and 160. First and second lower surface engaging rollers 174 and 176 are rotatably disposed on each axle 163 as are first and second upper surface engaging rollers 178 and 180. As FIG. 22 shows most clearly, the first and second lower surface engaging rollers 174 and 176 contact a lower boundary surface 172 of the arcuate channel 164 while the first and second upper surface engaging rollers 178 and 180 engage an upper boundary surface 170 of the arcuate channel 164. As one sees, the upper boundary surface 170 of the arcuate channel 164 extends across a bridge portion 166 of the pivot block 52.

The first and second upper surface engaging rollers 178 and 180 are disposed inboard of the first and second lower surface engaging rollers 174 and 176 and inboard of the arcuate channel 164 such that the upper surface engaging rollers 178 and 180 cannot contact the lower boundary surface 172. The upper surface engaging rollers 178 and 180 are larger than the lower surface engaging rollers 174 and 176 such that they prevent the lower surface engaging rollers 174 and 176 from contacting the upper boundary surface 170. Also, the sum of the radius of each lower surface engaging roller 174 and 176 plus the radius of its corresponding upper surface engaging roller 178 and 180 substantially equals the height of the arcuate channel 164.

With this, constant contact is ensured between the upper surface engaging rollers 178 and 180 and the upper boundary surface 170 and between the lower surface engaging rollers 174 and 176 and the lower boundary surface 172 such that all play between the carriage frame 26 and the main skate frame 12 is avoided as the rollers 174,176,178, and 180 roll in opposite rotational directions along the upper and lower boundary surfaces 170 and 172 respectively. In light of the complementary nature of the radii of the upper and lower surface engaging rollers 174,176,178, and 180, one will appreciate that the radii can be proportionately varied so long as they add to the height of the arcuate channel 164. To be complete, one will note that, although FIG. 21 shows an arrangement with two axles 163, more or less axles 163 could be provided along with appropriately disposed and sized rollers. Of course, such embodiments are well within the scope of the present invention.

Under any of these arrangements incorporating an arcuate passage 164, the location of the effective pivot axis 28 can be controlled by a manipulation of the orientation and the radius of curvature of the arcuate passage 164. With this, the location of the effective pivot axis 28 can be moved forward, backward, up, and down by a proper shaping of the arcuate passage 164. For example, the effective pivot axis 28 can be moved farther away from the arcuate passage 164 and related pivoting structures by forming the arcuate passage 164 with a larger radius of curvature. Also, the effective pivot axis 28 can be moved forward along the in-line skate 10 by rotating the orientation of the arcuate passage clockwise when viewed in right side elevation. Of course, the effective pivot axis 28 can be moved proximally by lessening the radius of curvature of the arcuate passage 164 or rearwardly by rotating the orientation of the arcuate passage counter-clockwise again when viewed in right side elevation.

In any of the foregoing embodiments, one will appreciate that a means for biasing the carriage frame 26 to a non-pivoted orientation could be provided. For example, one or more tension springs or bands (not shown) could each have a first end coupled to the main skate frame 12 and a second end coupled to the carriage frame 26. Alternatively, one or more compression springs or other resiliently compressible structures could be appropriately interposed between the main skate frame 12 and a forward portion of the carriage frame 26. Of course, the biasing means could assume a wide variety of additional forms that would be readily obvious to one skilled in the art after reading this disclosure. Each such embodiment is well within the scope of the present invention.

Figure 23:
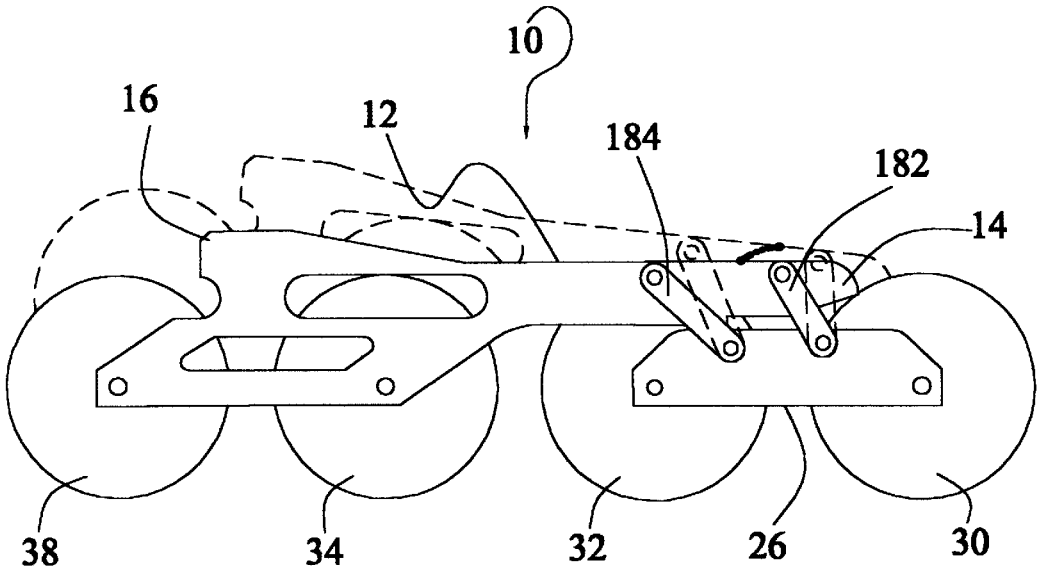
FIG. 23 is a view in side elevation of still another embodiment of the in-line skate according to the present invention.

Even further demonstrating that many different constructions would be well within the scope of the present invention is the embodiment of the in-line skate 10 of FIG. 23. There, the carriage frame 26 pivots relative to the main skate frame 12 by use of first and second pivot arms 182 and 184. As FIG. 23 illustrates, each pivot arm 182 and 184 has a first end pivotally coupled to the main skate frame 12 and a second end pivotally coupled to the carriage frame 26. In this embodiment, the first pivot arm 182 is significantly shorter than the second pivot arm 184. The first and second pivot arms 182 and 184 each may be considered to have anterior edges that face toward the anterior end 14 of the main skate frame 12 and posterior edges that face toward the posterior end 16 of the main skate frame 12. In practice, the carriage frame can pivot counter-clockwise relative to the drawing as the first and second pivot arms 182 and 184 pivot clockwise. The lengths and orientations of the first and second pivot arms 182 and 184 and their first and second ends can be manipulated to adjust the location of the effective axis of rotation of the carriage frame 26.

The astute observer will appreciate that this embodiment further illustrates that, under the present invention, the location of the effective axis of rotation of the carriage frame 26 need not necessarily be constant. Indeed, under the pivot arm embodiment of FIG. 23, it is likely that the effective axis of rotation of the overall carriage frame 26 will move as the carriage frame 26 is pivoted. Accordingly, it must be noted that the present invention and the claims that protect it include embodiments that provide for what essentially is a moving effective axis of rotation. This moving or variable axis of rotation could be accomplished in a number of manners including by the pivot arm arrangement of FIG. 23, arrangements with curves or arcuate channels 164 that have radii of curvature that vary along their lengths, or any one of a number of further mechanisms.

Figure 24:
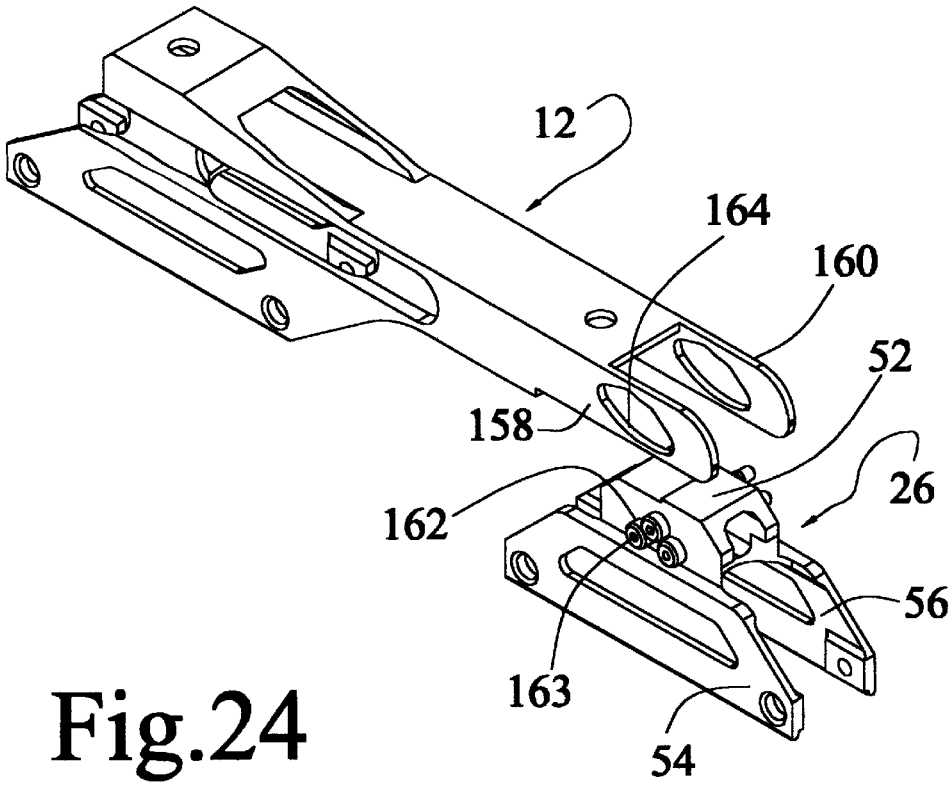
FIG. 24 is a partially exploded perspective view of yet another embodiment of the in-line skate.

Even further, one should be aware that, although the arcuate channel 164 is depicted as being in the carriage frame 26 and the axles 163 retained in place by the first and second pivot support plates 158 and 160 of the main skate frame 12, it is well within the scope of the invention for the structures to be reversed. Stated alternatively, as is shown in FIG. 24, it would be readily obvious for one to provide an arcuate channel 164 passing through the first and second pivot support plates 158 and 160 of the main skate frame 12 while having roller cylinders 162 on axles 163 disposed outboard of the pivot block 52 of the carriage frame 26.

Figure 25:
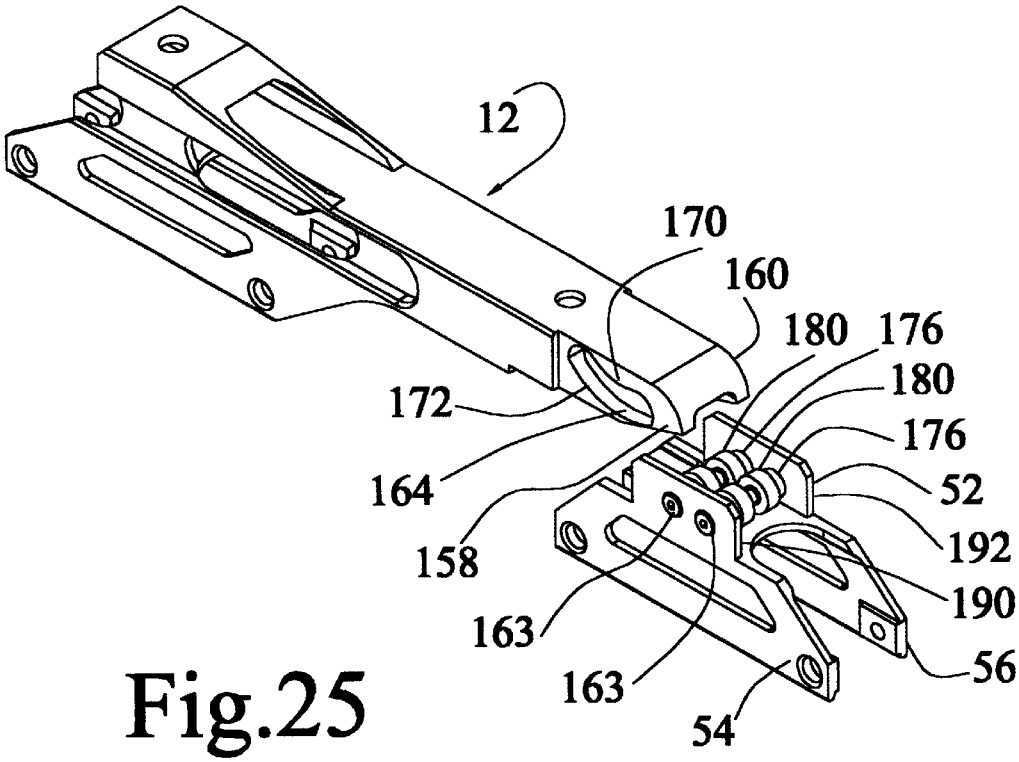
FIG. 25 is a partially exploded perspective view of an even further embodiment of the present invention for an in-line skate.

Similarly, the invention's scope includes the embodiment of FIG. 25 wherein the pivot block 52 has spaced first and second walls 190 and 192 that are disposed outboard of the first and second pivot support plates 158 and 160 and that retain the ends of axles 163. The axles 163 pass through the arcuate channel 164 that is disposed in the first and second pivot support plates 158 and 160. The axles 163 could rotatably retain cylinders (not shown) or they could retain upper and lower surface engaging rollers 174, 176, 178, and 180 that would again roll along upper and lower boundary surfaces 170 and 172. The function of this embodiment would be substantially similar to that of the embodiment of FIG. 21 except for the opposite disposition of the arcuate channel 164, the axles 163, and related structures.

From the foregoing, it will be clear that the present invention has been shown and described with reference to certain preferred embodiments that merely exemplify the broader invention revealed herein. Certainly, those skilled in the art can conceive of alternative embodiments. For instance, those with the major features of the invention in mind could craft embodiments that incorporate those major features while not incorporating all of the features included in the preferred embodiments.

With this in mind, the following claims are intended to define the scope of protection to be afforded the inventor, and the claims shall be deemed to include equivalent constructions insofar as they do not depart from the spirit and scope of the present invention. A plurality of the following claims may express certain elements as a means for performing a specific function, at times without the recital of structure or material. As the law demands, these claims shall be construed to cover not only the corresponding structure and material expressly described in the specification but also equivalents thereof.

I claim as deserving the protection of United States Letters Patent:

1. An in-line skate comprising:

a skate body with an anterior end and a posterior end;

a carriage frame;

a pivoting mechanism that pivotally couples the carriage frame to the skate body wherein the pivoting mechanism enables the carriage frame to pivot away from the skate body about an effective pivot axis that has a horizontal position and a vertical position and wherein the effective pivot axis is physically displaced from the pivoting mechanism wherein the pivoting mechanism comprises a first curved surface that is fixedly associated with the skate body in relatively slidable contact with a second curved surface that is fixedly associated with the carriage frame whereby the first and second curved surfaces can slide relative to one another to allow the carriage frame to pivot relative to the skate body:

whereby the carriage frame pivots about an effective pivot axis without requiring the pivoting mechanism to be located at the effective pivot axis; and whereby the carriage frame can pivot relative to the skate body to maintain contact with a ground surface throughout a range of pivoting of the skate body relative to a ground surface.

2. The in-line skate of claim 1 wherein the skate body comprises a main skate frame with a lower surface proximal to the pivoting mechanism and an upper surface distal to the pivoting mechanism and wherein the effective pivot axis is distal to the upper surface of the main skate frame relative to the carriage frame.

3. The in-line skate of claim 1 wherein the horizontal location of the effective pivot axis is adjacent to the anterior end of the skate body.

4. The in-line skate of claim 1 wherein the first and second curves have substantially identical radii of curvature whereby the first and second curves can be closely and smoothly engaged for sliding relative to one another.

5. The in-line skate of claim 1 wherein the first curved surface comprises an outside curve and wherein the second curved surface comprises an inside curve.

6. The in-line skate of claim 5 further comprising a means for interlockingly engaging the first and second curves.

7. The in-line skate of claim 6 wherein the means for interlockingly engaging the first and second curves comprises a pair of engaging shoulders in combination with a C-channel.

8. The in-line skate of claim 1 wherein the first and second curved surfaces have radii of curvature that are consistent along the first and second curved surfaces.

9. The in-line skate of claim 1 wherein the skate body further comprises a skate boot with an anterior end, a posterior end, a sole, and an open inner volume of a given length for receiving a skater's foot.

10. An in-line skate comprising;

a skate body with an anterior end and a posterior end;

a carriage frame;

a pivoting mechanism that pivotally couples the carriage frame to the skate body wherein the pivoting mechanism enables the carriage frame to pivot away from the skate body about an effective pivot axis that has a horizontal position and a vertical position and wherein the effective pivot axis is physically displaced from the pivoting mechanism wherein the pivoting mechanism comprises a laterally disposed arcuate passage in combination with a plurality of axles at least partially disposed in the arcuate passage whereby the carriage frame can pivot relative to the skate body by a traveling of the axles along the arcuate passage;

whereby the carriage frame pivots about an effective pivot axis without requiring the pivoting mechanism to be located at the effective pivot axis; and whereby the carriage frame can pivot relative to the skate body to maintain contact with a ground surface throughout a range of pivoting of the skate body relative to a ground surface.

11. The in-line skate of claim 10 wherein the carriage frame has first and second sides, wherein the arcuate passage is laterally disposed through the first and second sides of the carriage frame, wherein first and second pivot support members fixedly extend from the skate body adjacent to the first and second sides of the carriage frame, and wherein the plurality of axles have first and second ends coupled to the first and second pivot support members respectively and body portions that pass through the arcuate passage.

12. The in-line skate of claim 11 wherein there are at least three axles wherein the axles are disposed in a non-linear relationship that has a given effective height and wherein the arcuate passage has a height slightly greater than the effective height of the at least three axles.

13. The in-line skate of claim 12 wherein there are three axles and wherein the axles are disposed in a triangular configuration.

14. The in-line skate of claim 13 further comprising a cylinder rotatably disposed around each axle.

15. The in-line skate of claim 11 wherein the first and second pivot support members are fixed to the skate body.

16. The in-line skate of claim 11 wherein the first and second pivot support members are formed integrally with the skate body.

17. The in-line skate of claim 10 wherein first and second pivot support members fixedly extend from the skate body, wherein the arcuate passage is laterally disposed through the first and second pivot support members, and wherein the plurality of axles are retained by the carriage frame with at least a portion of each axle disposed within the arcuate passage.

18. The in-line skate of claim 17 wherein the are at least three axles wherein the axles are disposed in a non-linear relationship that has a given effective height and wherein the arcuate passage has a height slightly greater than the effective height of the at least three axles.

19. The in-line skate of claim 18 wherein there are three axles and wherein the axles are disposed in a triangular configuration.

20. The in-line skate of claim 19 further comprising a cylinder rotatably disposed around each axle.

21. The in-line skate of claim 10 further comprising at least one upper surface engaging roller surrounding at least one axle of the plurality of axles for rolling along an upper surface adjacent to the first axle but not in contact with a lower surface and at least one lower surface engaging roller surrounding at least one of the plurality of axles for rolling along the lower surface adjacent to that axle but not in contact with the upper surface.

22. The in-line skate of claim 21 wherein the upper surface engaging roller and the lower surface engaging roller have different radii.

23. The in-line skate of claim 22 wherein the distance between the upper surface against which the upper surface engaging roller rolls and the lower surface against which the lower surface engaging roller rolls as measured perpendicularly from the longitudinal axis of the at least one axle approximately equals the sum of the radii of the upper and lower surface engaging rollers whereby the carriage frame can pivot smoothly relative to the main skate frame but with substantially no play therebetween.

24. The in-line skate of claim 23 wherein each axle of the plurality of axles has first and second upper surface engaging rollers respectively spaced inboard of first and second lower surface engaging rollers.

25. An in-line skate comprising:

a skate body with an anterior end and a posterior end;

a carriage frame;

a pivoting mechanism that pivotally couples the carriage frame to the skate body wherein the pivoting mechanism enables the carriage frame to pivot away from the skate body about an effective pivot axis that has a horizontal position and a vertical position and wherein the effective pivot axis is physically displaced from the pivoting mechanism wherein the pivoting mechanism comprises at least first and second pivot arms wherein each of the first and second pivot arms has a first end pivotally coupled to the main skate frame and a second end pivotally coupled to the carriage frame;

whereby the carriage frame pivots about an effective pivot axis without requiring the pivoting mechanism to be located at the effective pivot axis; and whereby the carriage frame can pivot relative to the skate body to maintain contact with a ground surface throughout a range of pivoting of the skate body relative to a ground surface.

* * * * *